US008291674B2

(12) United States Patent
Valentz et al.

(10) Patent No.: US 8,291,674 B2
(45) **Date of Patent: *Oct. 23, 2012**

(54) WINDOW-CONTAINING ASSEMBLIES HAVING A MOLDED PLASTIC FRAME

(75) Inventors: Arthur J. Valentz, Sugar Land, TX (US); John E. Nemazi, Bloomfield Hills, MI (US); James W. Proscia, Dearborn, MI (US)

(73) Assignee: V-Tech Patents, L.L.C., Houston, TX (US)

( * ) Notice: Subject to any disclaimer, the term of this patent is extended or adjusted under 35 U.S.C. 154(b) by 14 days.

This patent is subject to a terminal disclaimer.

(21) Appl. No.: 12/834,277

(22) Filed: Jul. 12, 2010

(65) Prior Publication Data

US 2010/0275537 A1 Nov. 4, 2010

Related U.S. Application Data

(63) Continuation of application No. 11/057,891, filed on Feb. 12, 2005, now Pat. No. 7,762,028, which is a continuation-in-part of application No. 10/639,410, filed on Aug. 12, 2003, now Pat. No. 7,296,388, and a continuation-in-part of application No. PCT/US2004/026010, filed on Aug. 11, 2004.

(51) Int. Cl.

| | |
|---|---|
| ***E04B 1/00*** | (2006.01) |
| ***E04G 21/00*** | (2006.01) |
| ***E04G 23/00*** | (2006.01) |

(52) U.S. Cl. ..... 52/742.1; 52/204.591; 52/203; 52/200; 52/204.5; 428/34

(58) Field of Classification Search ..... 52/22, 64, 52/200, 203, 204.5, 204.591; 528/44, 45, 528/69; 428/34; 156/107, 109

See application file for complete search history.

(56) References Cited

U.S. PATENT DOCUMENTS 2,205,522 A 6/1940 Fix (Continued)

FOREIGN PATENT DOCUMENTS

DE 87 13 427 U1 11/1987

(Continued)

OTHER PUBLICATIONS

Supplemental European Search Report dated Dec. 14, 2009, 3 pages.

(Continued)

*Primary Examiner* — William Gilbert
*Assistant Examiner* — Chi Q Nguyen
(74) *Attorney, Agent, or Firm* — Brooks & Kushman P.C.

(57) ABSTRACT

The present invention provides a window frame design that is adapted to receive at least two light-panels. The window frame comprises a stepped frame section that includes a lower step surface and an upper step surface. The lower step surface is adapted to receive a first light-panel so that a section of the first light-panel lies flush against the lower step surface. Similarly, the upper step surface is adapted to receive a second light-panel so that the second light-panel lies flush against the upper step surface. The window frame design of the invention can be either incorporated into a skylight frame that may be attached to a curb unit on a roof or it may be an integral part of a skylight frame-curb assembly that also contains a curb section. In another embodiment of the invention, a window frame design which directly incorporates one or more light-panels during molding is provided.

10 Claims, 25 Drawing Sheets

U.S. PATENT DOCUMENTS 3,434,250 A 3/1969 Kiekhaefer
3,434,251 A 3/1969 Kiekhaefer
4,073,097 A 2/1978 Jentoft et al.
4,114,330 A 9/1978 Sukolics
4,173,854 A 11/1979 Wallerstein
4,193,237 A 3/1980 Jankowski
4,223,493 A 9/1980 Moench et al.
4,296,578 A * 10/1981 Keckman ..... 52/200
4,333,295 A 6/1982 Janke
4,388,784 A 6/1983 Jentoft et al.
4,389,823 A 6/1983 Player
4,408,422 A 10/1983 Bechtold
4,439,962 A 4/1984 Jentoft et al.
4,470,230 A 9/1984 Weisner
4,514,943 A 5/1985 Jentoft et al.
4,520,604 A 6/1985 Halsey et al.
4,527,368 A 7/1985 Jentoft
4,548,006 A 10/1985 Roberts, Sr.
4,549,379 A 10/1985 Hoy et al.
4,589,238 A 5/1986 Sampson et al.
4,594,821 A 6/1986 Bechtold et al.
4,610,116 A 9/1986 Schulz
4,649,680 A 3/1987 Weisner et al.
4,685,256 A 8/1987 Alkjaer
4,702,049 A 10/1987 Sampson et al.
RE32,539 E 11/1987 Jentoft et al.
4,703,592 A 11/1987 Sampson et al.
4,730,426 A 3/1988 Weisner et al.
4,750,302 A 6/1988 Bechtold
4,762,160 A 8/1988 Bechtold et al.
4,788,804 A 12/1988 Haas
4,796,400 A 1/1989 Mulder
4,825,608 A 5/1989 Makin
4,830,038 A 5/1989 Anderson et al.
4,860,511 A 8/1989 Weisner et al.
4,884,379 A 12/1989 McCabe
4,896,468 A 1/1990 Sampson et al.
4,924,649 A 5/1990 Taylor
4,926,594 A 5/1990 Sampson et al.
4,928,445 A 5/1990 Sampson et al.
4,930,274 A 6/1990 Cummings et al.
4,930,275 A 6/1990 Verby et al.
4,941,302 A 7/1990 Barry
4,952,430 A 8/1990 Bowser et al.
4,986,039 A 1/1991 Weisner
4,987,705 A 1/1991 Sampson et al.
4,995,208 A 2/1991 Sampson et al.
5,008,062 A 4/1991 Anderson et al.
5,044,133 A 9/1991 Sampson et al.
5,046,292 A 9/1991 Sampson et al.
RE33,720 E 10/1991 Cummings
5,059,254 A 10/1991 Yaba et al.
5,061,531 A * 10/1991 Catalano ..... 428/34
5,092,089 A 3/1992 Kessler
5,103,603 A 4/1992 Verby et al.
5,148,643 A 9/1992 Sampson et al.
5,199,234 A 4/1993 Guhl
5,207,036 A 5/1993 Sampson et al.
5,237,788 A 8/1993 Sandow
5,291,705 A 3/1994 Dickerson
5,323,576 A 6/1994 Gumpert et al.
5,394,664 A 3/1995 Nowell
5,419,090 A 5/1995 Sandow
5,502,934 A 4/1996 Coyne et al.
5,528,471 A 6/1996 Green
5,544,455 A 8/1996 DeBlock
5,581,971 A 12/1996 Peterson
5,617,682 A 4/1997 Christopher
5,640,828 A 6/1997 Reeves et al.
5,675,940 A 10/1997 Bahar et al.
5,715,634 A 2/1998 Schultz
5,765,324 A 6/1998 Schultz
5,778,629 A 7/1998 Howes
5,784,853 A 7/1998 Hood et al.
5,806,255 A 9/1998 Verby et al.
5,913,785 A 6/1999 Moller et al.
6,019,918 A 2/2000 Guergov
6,052,956 A 4/2000 Hoy et al.
6,138,433 A 10/2000 Ridge
6,172,295 B1 1/2001 Hattori et al.
6,242,555 B1 * 6/2001 Du Prez et al. ..... 528/52
6,263,624 B1 7/2001 Hoy et al.
6,378,586 B1 4/2002 Lafond
6,418,679 B2 7/2002 Widmer
6,715,245 B2 * 4/2004 Lewkowitz ..... 52/208
6,784,255 B1 8/2004 Nakahama et al.
6,886,297 B1 5/2005 Crandell
7,049,803 B2 5/2006 Dorner et al.
7,296,388 B2 * 11/2007 Valentz et al. ..... 52/200
7,631,464 B2 * 12/2009 Valentz et al. ..... 52/200
7,762,028 B2 * 7/2010 Valentz et al. ..... 52/204.5

FOREIGN PATENT DOCUMENTS

DE 295 03 974 U1 4/1995
DE 87 12 476 U1 12/2009
WO 2005/021886 A1 3/2005

OTHER PUBLICATIONS

Machine Translation of DE 87 13 427, 4 pages.
Machine Translation of DE 87 12 476, 4 pages.
Machine Translation of DE 295 03 974 U1, 6 pages.
Non-Final Office Action dated Dec. 15, 2009 in U.S. Appl. No. 11/923,078, filed Oct. 24, 2007, 14 pgs.
Final Office Action dated Jul. 12, 2010 in U.S. Appl. No. 11/923,078, filed Oct. 24, 2007, 8 pgs.
Non-Final Office Action dated Nov. 17, 2010 in U.S. Appl. No. 11/923,078, filed Oct. 24, 2007, 7 pgs.
Non-Final Office Action dated Oct. 18, 2011 in U.S. Appl. No. 13/222,265, filed Aug. 31, 2011, 34 pgs.

* cited by examiner

WINDOW-CONTAINING ASSEMBLIES HAVING A MOLDED PLASTIC FRAME

CROSS-REFERENCE TO RELATED APPLICATIONS

This application is a continuation of U.S. application Ser. No. 11/057,891, filed Feb. 12, 2005, U.S. Pat. No. 7,762,028, issued Jul. 27, 2010, which is a continuation-in-part of U.S. application Ser. No. 10/639,410 filed Aug. 12, 2003, U.S. Pat. No. 7,296,388, issued Nov. 20, 2007, and of International Application Serial No. PCT/US2004/026010, filed Aug. 11, 2004. The disclosures of each of these applications are incorporated in their entirety by reference herein.

BACKGROUND OF THE INVENTION

1. Field of the Invention

The present invention relates to a window-containing structures having a plastic frame.

2. Background Art

Windows are integral parts of a variety of building components which include skylights, doors, conventional windows, and the like. Skylights for example have been used to allow light into residential and commercial buildings through an opening. The aesthetic value and possible health benefits of having sunlight in buildings have lead to an increasing demand for these structures. Ideally, a skylight will let light in while keeping other environmental elements out. However, since the installation of a skylight requires that an opening be cut in a roof, sealing such units has presented numerous challenges.

Popular skylight configurations include, for example, fixed skylights with flat or domed-shaped glass, ventilation skylights, egress skylights, and balcony skylights. In the fixed skylight configuration, the skylight functions essentially as a window that does not open. Ventilation skylights are similar, but may be opened a few inches to allow air circulation. Ventilation skylights may be opened by a pole or by a small electric motor. Egress roof skylights are capable of being opened by a sufficient amount for a person to move through. Balcony roof skylights which are usually installed on relatively steep roofs open to form a small balcony on which a person may stand.

In the typical fixed skylight installation a rectangular opening is cut in a roof. This opening will go through the plywood sheets in the roof. A curb unit is then attached to the plywood sheets of the roof. The external curb surfaces are then flashed with either roof boards or metal sheets to provide a leak-tight seal between the curb and roof. The skylight frame is then attached to the top surface of the curb unit. The skylight frame will usually have one or more glass panels surrounded by an aluminum trim frame. The glass panels are separated by a spacer which seals the interior cavity between the panels. The configuration for the glass panels is the same as that typically used in insulated window constructions. Transparent plastic panels may be used instead of glass panels. Additionally, the panels may be domed-shaped if desired. Such curbs are usually made of wood with a metal flashing along the sides of the curb. Generally, these curbs are fabricated on-site during the installation of the skylight. For stationary skylights, a leak tight seal will be formed between the skylight and the curb. Over time this leak tight seal often degrades and leaks. Furthermore, the application of a sealant to the curb may cause complications with the skylight manufacture tolerances by leaving a space between the metal flashing along the sides of the curb and the top of the curb. Foamed tapes have been used in place of sealants. However, such tapes do not adhere as well as sealants. Gaskets have been applied to both seal the skylight frame to a curb and to file the space between the metal flashing and the curb. Such configurations tend to be expensive and require rather strict tolerances. Moreover, the gasket can not be modified on-site.

Skylights have been formed with components made by reaction injection molding ("RIM"). U.S. Pat. No. 5,061,531 ("the '531 patent") discloses a framed insulating glass unit with an integral skylight frame and an integral curb made by the RIM process. In the framed insulating glass unit of the '531 patent, two glass plates are molded into a frame member by a polyurethane RIM process. RIM is a process of molding plastic parts using liquid monomers. It is capable of forming solid or foam parts that can vary from being flexible to extremely rigid. Polyurethanes are probably the most common plastics from which parts are made by the RIM process. RIM polyurethane is made by combining an isocyanate and a polyol.

In the typical RIM process, the liquids are pumped into and combined in a mixer under a pressure between about 1,500 and 3,000 psi. The liquids are then introduced into the mold under a low pressure (about 1 atm). An exothermic chemical reaction occurs in the mold causing the liquid to solidify without heating or cooling. Parts fabricated by RIM offer several advantages over other molding processes. Although parts produced by RIM are similar to parts made by injection molding, RIM parts may be made with shorter production time and less cost. Furthermore, RIM does not require high temperatures or pressures typical of injection molding thereby making it possible to make the molds out of inexpensive materials such as aluminum. However, the RIM process presents a number of considerations that complicates part fabrication. For example, the processing temperature, pressure and viscosity must be accurately controlled since the polymerization of the monomers takes place in the mold. Furthermore, the mixing head must be completely purged after each part is formed to prevent clogging. Finally, the relatively protracted cycle times for forming larger parts and the limited choices of polymers (mostly polyurethanes) make RIM a somewhat undesirable process.

In addition to the demands set forth above for skylights, improvements in the construction and sealing of other building components that include windows are needed. Typically, these window-containing components include numerous parts that need to be assembled and sealed. Cost savings is but one reason dictating the desirability of improving the methods of manufacturing such components.

Accordingly, there exists a need for an improved skylight and other window-containing constructions that are inexpensive to fabricate with a minimal number of seamed junctions.

SUMMARY OF THE INVENTION

The present invention overcomes the prior art by providing a window frame section adapted to receive at least two light-panels. The window frame section of the invention is advantageously used in any construction that includes one or more windows including, for example, skylights, doors, and conventional windows. Examples of conventional windows that may incorporate the window frame of the invention include bay windows, awning windows, casement windows while examples of doors include internal and external sliding and hinged doors. In a variation, the window frame section of the present invention comprises a quadrilateral frame and a stepped frame section that is integral to the quadrilateral frame. The stepped frame section includes a lower step surface and an upper step surface. The stepped frame section is able to receive a window assembly which has at least two window panels and which has an edge detail that is complementary to the stepped frame section. The window assembly is complementary by having at least a single step along its peripheral edges. In a variation, the lower step surface is adapted to receive a first light-panel so that a section of the first light-panel lies flush against the lower step surface. Similarly, the upper step surface is adapted to receive a second light-panel so that the second light-panel lies flush against the upper step surface. In another variation a spacer is interposed between the second light-panel and the upper step surface such that a surface of the spacer lies flush against the upper step surface (instead of the edge of the second light-panel.) The first light-panel is characterized by a first length and a first width and the second light-panel is characterized by a second length and a second width, such that the first length is less than the second length and the first width is less than second width. The first and second light-panels are advantageously combined together in an insulated glass unit. In one variation of the invention, the window frame section includes a curb section which is integral to the quadrilateral frame. The curb section includes a surface that is adapted to lie on a surface such as a roof. Examples of this variation include skylights which are flashed to a roof in a leak tight manner by methods known to one skilled in the art of skylight installation.

In another embodiment of the invention, a skylight frame adapted to be attached to a curb is provided. The skylight frame includes a stepped frame section having a lower step surface and an upper step surface. The stepped frame section is adapted to receive a window assembly as set forth above. In a variation, the lower step surface is adapted to receive a first light-panel so that a section of the first light-panel lies flush against the lower step surface. Similarly, the upper step surface is adapted to receive a second light-panel so that the second light-panel lies flush against the upper step surface (or a spacer lies flush if such a spacer is interposed between the upper step surface and the second light-panel.) The first and second light-panels are advantageously combined together in an insulated glass unit.

In another embodiment of the present invention, a skylight frame-curb assembly having a U-shaped trough with a mounting flange extending from one side of the U-shaped trough is provided. The skylight frame-curb assembly of this embodiment also includes the stepped frame section as described above. The trough of the present embodiment is filled with a foamed plastic in order to provide rigidity while reducing the weight of the skylight frame-curb assembly.

In another embodiment of the present invention, a skylight frame having one or more central support members is provided. The sides of the frame of this embodiment also include the stepped frame section described above. The one or more central support members include a lower step surface for receiving a lower light-panel. In this embodiment several lower light-panels are mounted between the lower step surfaces of the sides and the central support member. The upper light-panel surface in this design is a single light-panel which is received by the upper step surface of the sides. The upper light-panel also rests on the upper surface of the central support member.

In another embodiment of the present invention, a skylight frame-curb assembly fabricated by the RIM process is provided. In this embodiment, one or more light-panels are molded into the skylight frame section during formation of the skylight frame. The skylight frame assembly includes a frame section with slot adapted to hold one or more light-panels.

In still another embodiment of the present invention, an injection molded skylight curb unit is provided. The skylight curb unit includes four hollow sides that define a substantially rectangular or square opening. A flexible apron extends outwardly from the sides to provide a surface that is adapted to be placed on a rooftop. The side of the apron opposing the roof may be sealed to the roof and the entire apron flashed to a roof by methods known to those in the art of skylight installation.

In yet another embodiment of the present invention, a method of making a skylight frame is provided. The method of this embodiment comprises extruding a plastic channel with a stepped frame section integral to a lower curb portion. The frame section is similar to that set forth above. The plastic channel is then cut into four side sections which are then combined together to form the skylight frame.

DETAILED DESCRIPTION OF THE PREFERRED EMBODIMENTS

Reference will now be made in detail to presently preferred compositions or embodiments and methods of the invention, which constitute the best modes of practicing the invention presently known to the inventors.

As used herein, the term "light-panel" means a medium through which light is admitted. Such media include transparent or translucent glass and plastic panels.

In an embodiment of the present invention, a skylight frame-curb assembly adapted to receive at least two light-panels is provided. In some variations, these light panels are glass panels. The skylight frame-curb assembly of this embodiment provides one example utilizing the window frame section of the invention. Additional example are set forth below. The skylight frame-curb assembly of the present invention comprises a quadrilateral frame with an integral stepped frame section. The quadrilateral frame is preferably substantially rectangular. The stepped frame section includes a lower step surface and an upper step surface. The stepped frame section is able to receive a window assembly which has at least two window panels and which has an edge detail that is complementary to the stepped frame section. The window assembly is complementary by having at least a single step along its peripheral edges. In one variation, the lower step surface is adapted to receive a first light-panel so that a section of the first light-panel lies flush against the lower step surface. Similarly, the upper step surface is adapted to receive a second light-panel so that the second light-panel lies flush against the upper step surface. In another variation, a spacer lies flush against the upper step surface if such a spacer is interposed between the upper step surface and the second light-panel. The present invention also includes other skylight frame designs that may include additional stepped frame sections for receiving window assemblies with more complicated edge detail.

Figure 1:
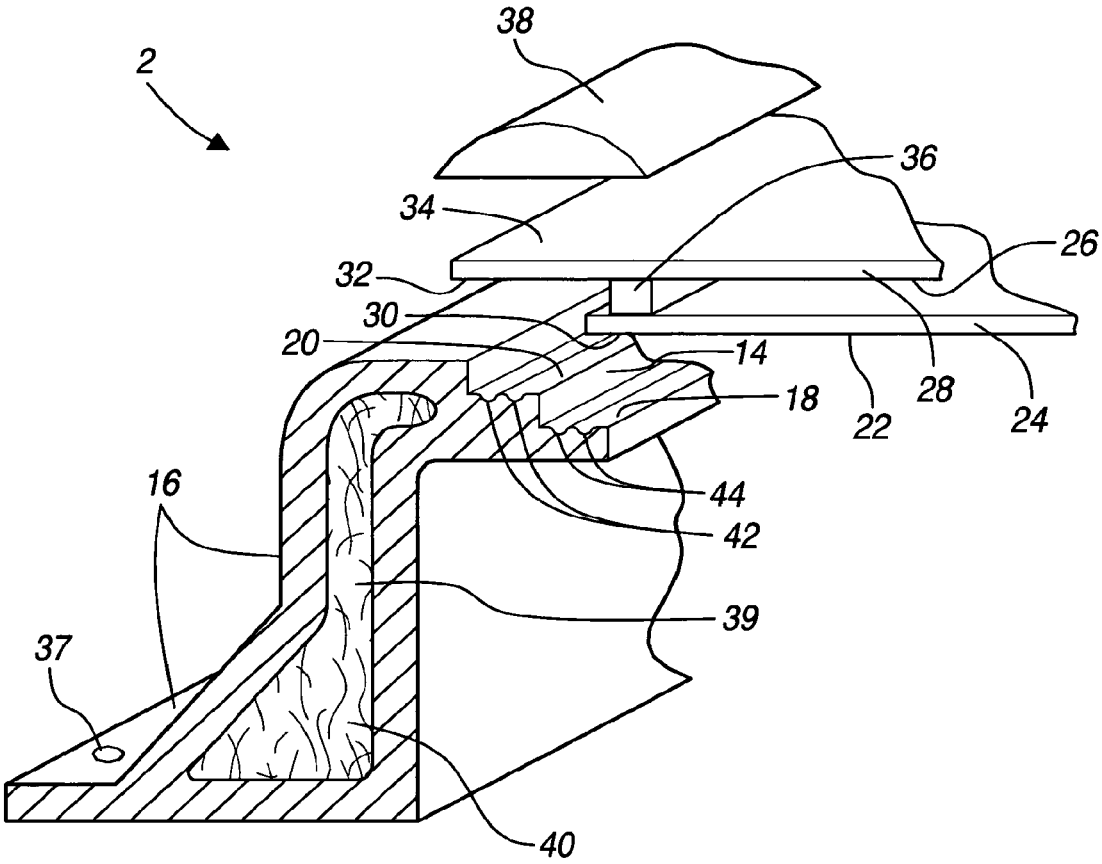
FIG. 1 is a perspective cross-sectional view of the skylight frame-curb assembly of the present invention.
Figure 2:
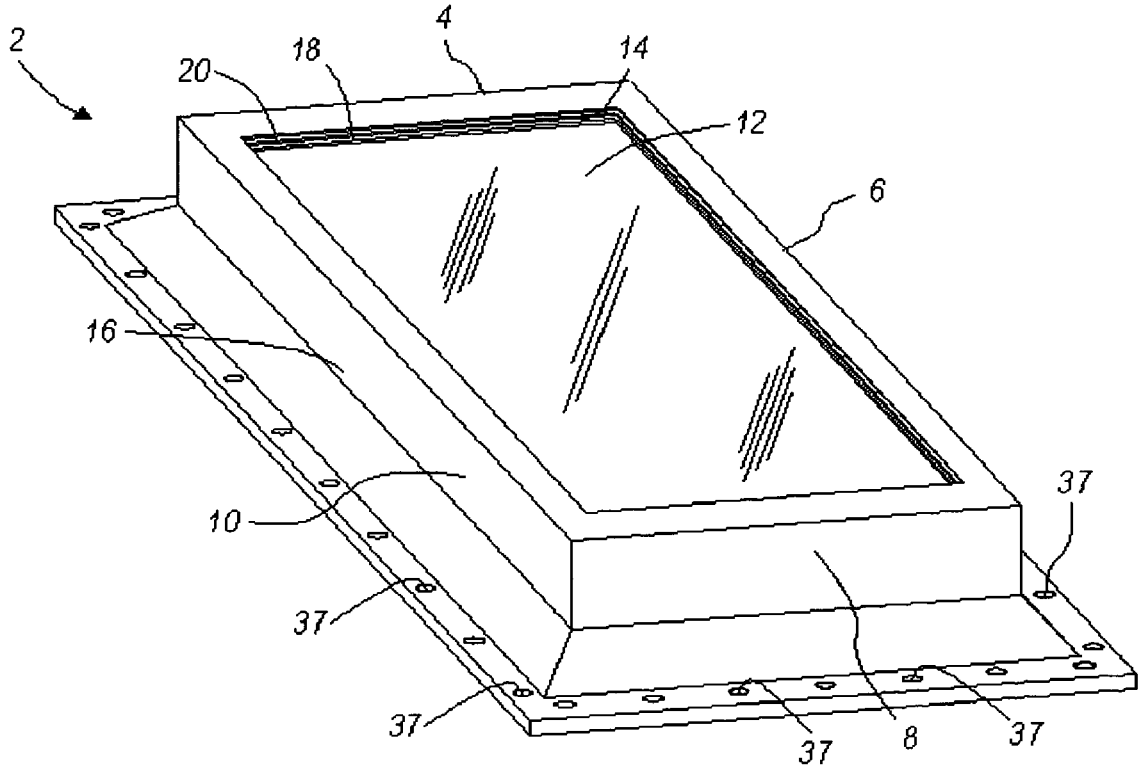
FIG. 2 is a perspective view of the skylight frame-curb assembly of the present invention.

With reference to FIGS. 1 and 2, a perspective view of a cross-section and a top view of the skylight frame-curb assembly of the present invention is provided. Skylight frame-curb assembly 2 includes sides 4, 6, 8, 10 which define opening 12. Opening 12 is of appropriate size to line up with a skylight opening curb into a roof. Sides 4, 6, 8, 10 each include stepped frame section 14 and curb section 16 which are integral to skylight frame-curb assembly 2. Stepped frame section 14 includes lower step surface 18 and an upper step surface 20. Lower step surface 18 is adapted to receive light-panel surface 22 of light-panel 24 and upper step surface 20 is adapted to receive light-panel surface 26 of light-panel 28. Specifically, light-panel peripheral surface 30 opposes lower step surface 18 and light-panel peripheral surface 32 opposes upper stepped surface 20. Light-panel 24 is characterized by a first length and a first width and light-panel 28 is characterized by a second length and a second width, such that the first length is less than the second length and the first width is less than second width. Preferably, light-panel 24 and light-panel 28 are combined together in insulated glass unit 34 with a spacer 36. In a variation of this embodiment, spacer 36 may extend beyond the edge of light-panel 24. In this variation a lower surface of spacer 36 opposes upper step surface 20 (see the description of FIG. 11B set forth below.) Alternatively, light-panel 24 and light-panel 28 are laminated together like an automobile windshield. Suitable laminates include, for example, polyvinylbutyral. Lamination of light-panels 24, 28 provide added protection from glass breakage. Stepped frame section 14 corresponds in shape to the edge detail and thickness of the insulating glass unit (or the laminated glass unit) so that the insulating glass unit is mounted flush.

The skylight of the present design lends itself to a wide array of aesthetic appearances. The insulated glass units can be fabricated using colored glass to achieve a desired color and thermal properties. Alternatively, one or more surfaces of light-panels 24 and 28 may be coated with thin films to alter the appearance of the skylight or to provide solar control properties. For example, in northern climates a low E coating is applied to one or more of the light panel surfaces (typically glass in this variation). In southern climates, reflective coatings capable of rejecting 80-90% of the radiant energy could be utilized to minimize air conditioning costs. Furthermore, the color of the light-panel on the peripheral portion can be selected to provide the desired aesthetic appearance. Curb section 16 optionally includes a number of bolt holes 37 so that skylight frame curb assembly 2 may be attached to a roof. During installation, curb section 16 will be flashed to the roof by methods known to those skilled in the art of skylight installation. Skylight frame-curb assembly 2 optionally includes trim strip 38 which can be provided at the overlap of insulated glass unit 34 and skylight frame-curb assembly 2.

Skylight frame-curb assembly 2 may be formed from any suitable material which supplies suitable mechanical stiffness and resistance to deterioration from environment factors such a temperature, humidity, sunlight, air, rain, snow, hale, and the like. Suitable materials include for example various plastics, wood, and metals. The preferred materials are plastics such as thermoplastic resins (i.e., polyvinylchloride, polyethylene, polypropylene, or nylon) and polyurethanes. When a plastic is utilized to mold skylight frame-curb assembly 2 a glass fiber reinforcement filler may be used in the plastic composition selected in order to minimize the thermal expansion of skylight frame-curb assembly 2. Skylight frame-curb assembly 2 may be formed by a number of different molding processes. For example, skylight frame-curb 2 may be formed by injection molding, vacuum molding, compression molding, or by RIM. When the RIM process is used to form the skylight frame-curb assemblies of the invention, preferably, polyurethane is used as the material of construction. In such a process, an isocyanate component is reacted with an isocyanate-reactive component (i.e., a polyol) in a mold having an interior cavity complementary to the window frame. A particularly useful polyurethane composition and RIM molding process is provided by U.S. Pat. No. 6,242,555 (the '555 patent), the entire disclosure of which is hereby incorporated by reference. Specifically, in accordance with this process an isocyanate component containing an isophorone diisocyanate (IPDI) trimer/monomer mixture having an NCO content of from 24.5 to 34% by weight, is reacted with isocyanate-reactive components in the presence of at least one catalyst component, at least one pigment component, and at least one antioxidant/UV absorber component. The isocyanate-reactive components comprise a polyetherpolyol having terminal OH groups, an average nominal functionality of 2 to 4, and an average equivalent weight of from 800 to 4000; at least one chain extender component having as functional groups only aliphatic or alicyclic OH groups; and at least one amine-initiator component. The catalyst component is selected from the group consisting of organolead (II), organobismuth (III), and organotin (IV) catalysts.

The preferred molding process is chosen to improve strength and to minimize part weight and to provide optimum thermal insulation qualities. To this end, skylight frame-curb assembly 2 optionally includes one or more hollow cores 39 that may be filled with foamed plastic 40. Skylight frame-curb assemblies with hollow cavities may be made by gas assisted injection molding which uses a conventional injection molding press equipped with a spillover control and a mold equipped with gas injection and spillover points. Suitable gas assisted injection molding processes which may be used to form the skylight frame-curb assembly of the present invention are described in U.S. Pat. No. 6,019,918. The entire disclosure of this patent is hereby incorporated by reference. The foam material is then introduced through inlet holes after the frame is molded. Alternatively, the part can be molded utilizing a plastic foaming agent, the surface of the plastic part having a smooth uniform skin while the inner core contains a series of gas bubbles forming a rigid foam or sponge-like core. The skylight frame-curb assembly may also be made by compression molding using either sheet molding compound ("SMC") or bulk molding compound.

Insulating glass unit 34 is bonded to stepped flange section 14 of skylight frame-curb assembly 2 utilizing adhesives in a manner similar to mounting a flush glazed windshield in an automobile. Preferably, light-panel surface 26 of the light-panel 28 has a peripheral edge painted to provide an aesthetic detail as well as improve the adhesion of the bond between the light-panel 28 and frame curb assembly 2. Optionally, grooves 42, 44 may be formed on lower step surface 18 and upper step surface 20 in order to provide a relatively thick bead of adhesive in order to accommodate some slight relative movement due to the differential thermal expansion of insulated glass unit 34 in order to further minimize the mold expansion problems.

Figure 3:
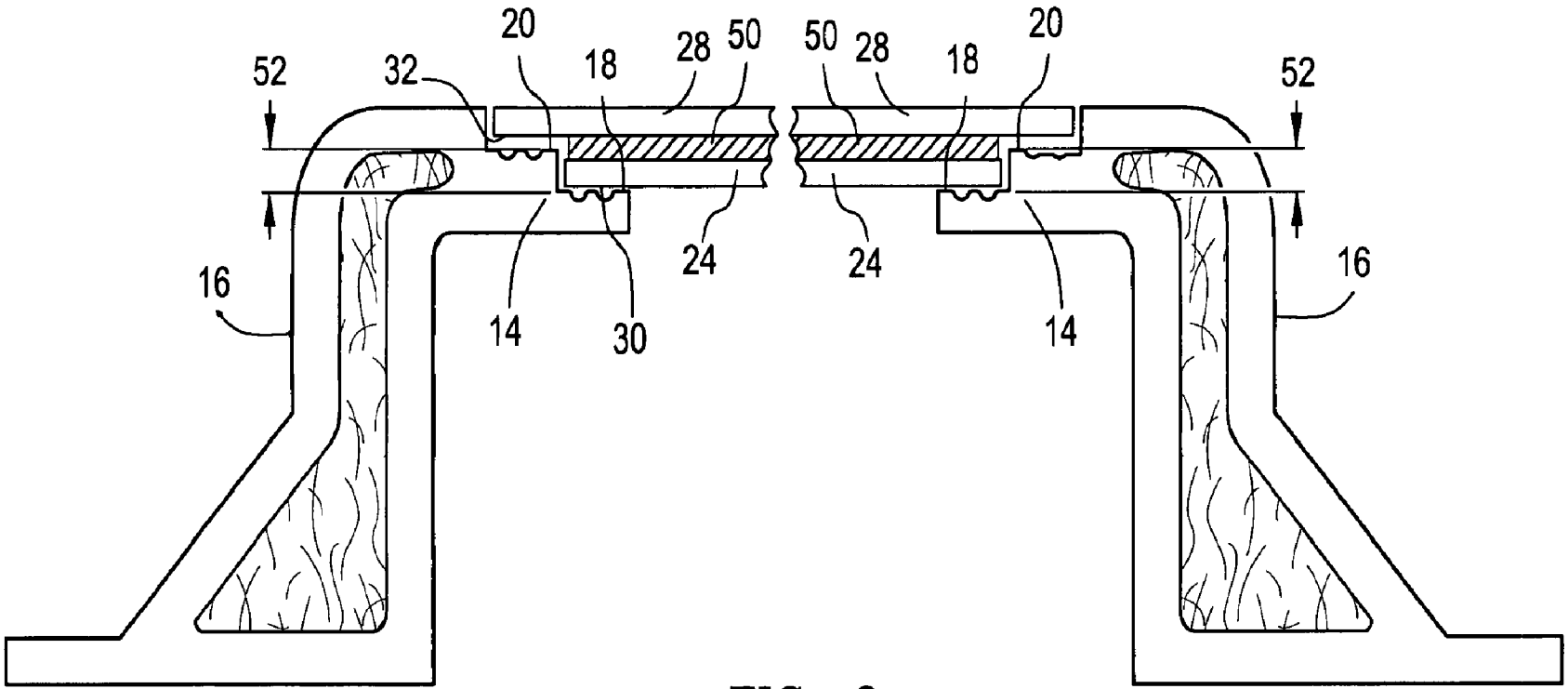
FIG. 3 is a cross-section of a skylight frame-curb assembly of the present invention with an attached laminated glass sheet.

With reference to FIG. 3, a cross-section of a skylight frame-curb assembly with an attached laminated glass sheet is provided. In this variation light-panel 24 and light-panel 28 are laminated together with laminate layer 50. In some variations, these light panels are glass panels. Light-panel 28 is slightly larger than light-panel 24. Light-panel edge 30 opposes lower step surface 18 and light-panel edge 32 opposes upper stepped surface 20. In this variation, height 52 must be of appropriate dimensions to allow an effective seal when an adhesive is applied to lower set surface 18 and upper step surface 20. Generally, height 52 will be several millimeters.

Figure 4:
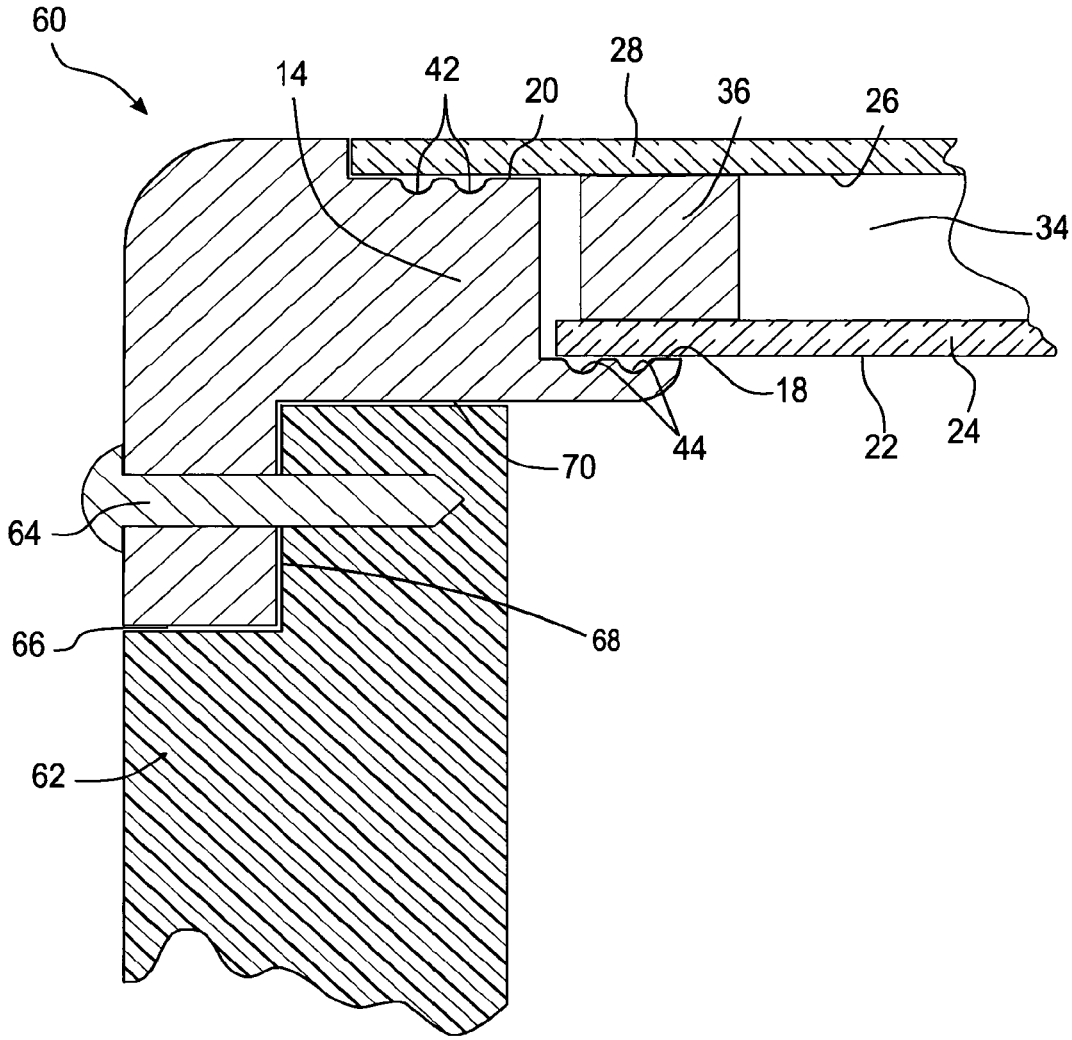
FIG. 4 is a cross-sectional view of an embodiment of the present invention in which the stepped frame section is on a separate part from the curb.

With reference to FIG. 4, a cross-sectional view of an embodiment of the present invention in which the stepped frame section is on a separate part from the curb is provided. Frame 60 includes stepped frame section 14 which is the same as set forth above. Stepped frame section 14 includes lower step surface 18 and upper step surface 20. Lower step surface 18 is adapted to receive light-panel surface 22 of light-panel 24 and upper step surface 20 is adapted to receive light-panel surface 26 of light-panel 28 with or without a spacer interposed between light-panel 28 and upper step surface 20. Light-panel 24 is characterized by a first length and a first width and light-panel 28 is characterized by a second length and a second width, such that the first length is less than the second length and the first width is less than second width. Preferably, light-panel 24 and light-panel 28 are combined together in insulating glass unit 34 or a laminated glass unit as set forth above. Frame 60 may be formed from the same materials and by the same molding processes as set forth above. Frame 60 is attached to curb 62. This attachment may be accomplished by means known to one skilled in the art of skylight installation. Preferably, frame 60 is bolted to curb 62 by bolts 64. Optionally, a sealant may be placed on one or more of seams 66, 68, 70 to reduce the possibility of water leaking from the skylight. The frame assembly of this embodiment allows insulated glass unit 34 and frame 60 to be replaced in the event a window is damaged during or after construction. This is to be contrasted with a damaged insulated glass unit for the design of FIGS. 1 and 2, which would require replacement in a manner similar to the replacement of an automobile windshield. The two piece design of the present embodiment enables a less skilled person to do the window replacement by unbolting frame 60 and replacing the whole unit—frame 60 and insulated glass unit 32. Moreover, insulated glass unit and frames can be made standard sizes and matched up with curbs of a selected height and thermal quality for the specific market.

Figure 5:
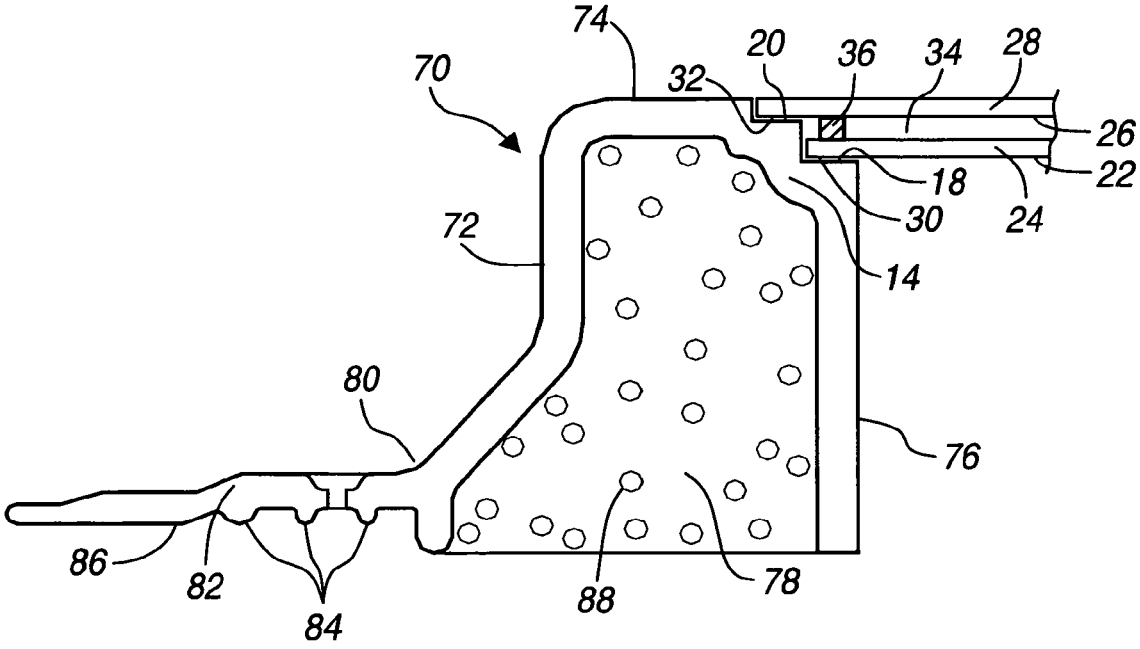
FIG. 5 is a cross-sectional view of an embodiment of the present invention in which the frame curb assembly has a U-shaped trough with a mounting flange extending from one side of the U-shaped trough.

With reference to FIG. 5, a cross-section of another embodiment of the present invention in which the frame curb assembly has a U-shaped trough with a mounting flange extending from one side of the U-shaped trough is provided. Skylight frame-curb assembly 70 includes stepped frame section 14. As set forth above, stepped frame section 14 includes lower step surface 18 and upper step surface 20. Again, lower step surface 18 is adapted to receive light-panel surface 22 of light-panel 24 and upper step surface 20 is adapted to receive light-panel surface 26 of light-panel 28 with or without a spacer interposed between light-panel 28 and upper step surface 20. Light-panel 24 is characterized by a first length and a first width and light-panel 28 is characterized by a second length and a second width, such that the first length is less than the second length and the first width is less than second width.

Preferably, light-panel 24 and light-panel 28 are combined together in insulated glass unit 34 with a spacer 36. Skylight frame-curb assembly include sides 72, 74, 76 which define trough 78. Curb section 80 includes mounting flange 82 which extends from the bottom of side 72. Ribs 84 extend from bottom surface 86 of mounting flange 82 to provide stiffness. Skylight frame-curb assembly 70 may be formed by the same molding processes as described above which include injection molding from thermoplastic resins or by RIM. After skylight frame-curb assembly 70 is molded, trough 78 is filled with foamed plastic 88 in a second operation. Foamed plastic 88 provides rigidity to skylight frame-curb assembly 70 as well as good thermal insulation. Light-panels 24, 28 are installed in a similar manner to the installation of an automobile windshield. Accordingly, an adhesive is applied between light-panel edge 30 and lower step surface 18 and between light-panel edge 32 and upper stepped surface 34.

Figure 6:
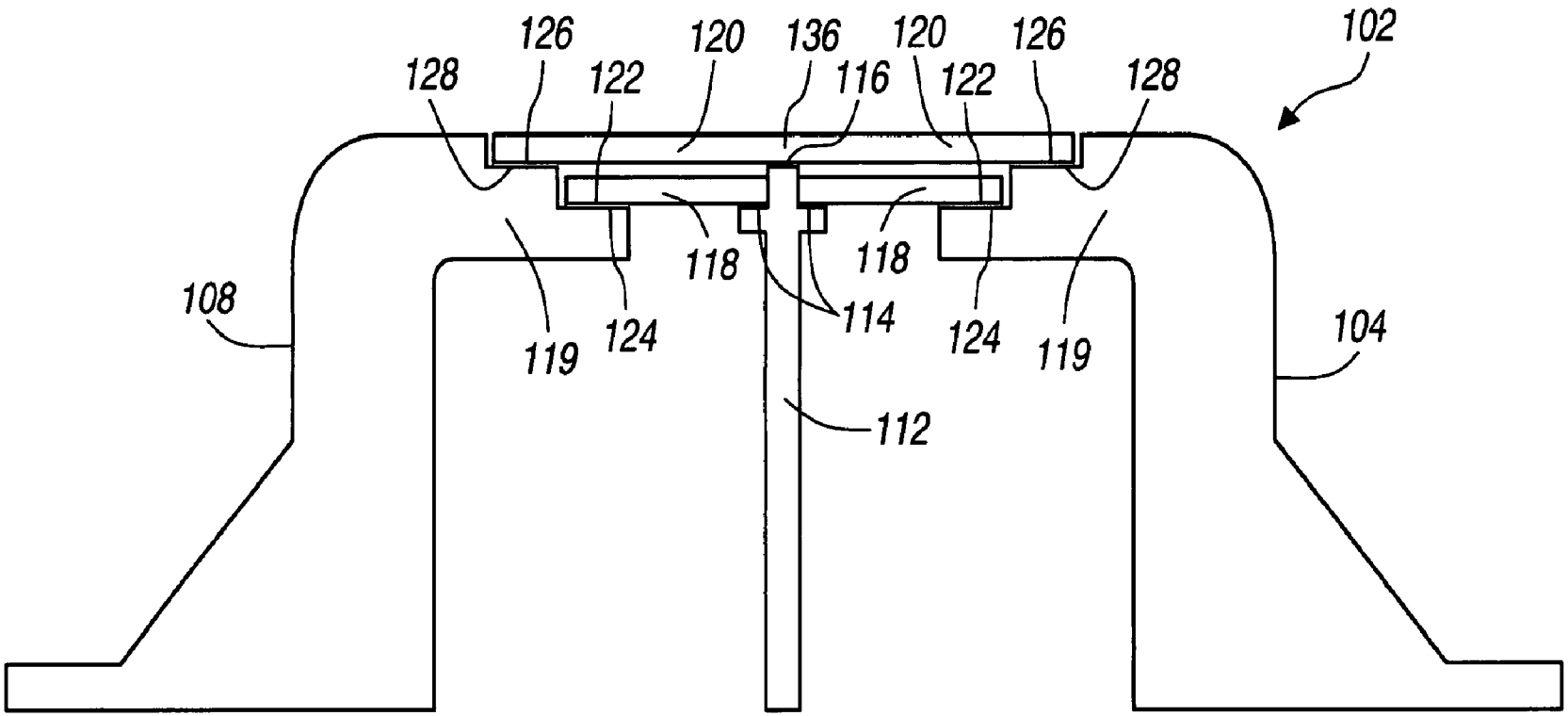
FIG. 6 is a cross-sectional view of an embodiment of the present invention utilizing a central cross member.
Figure 7:
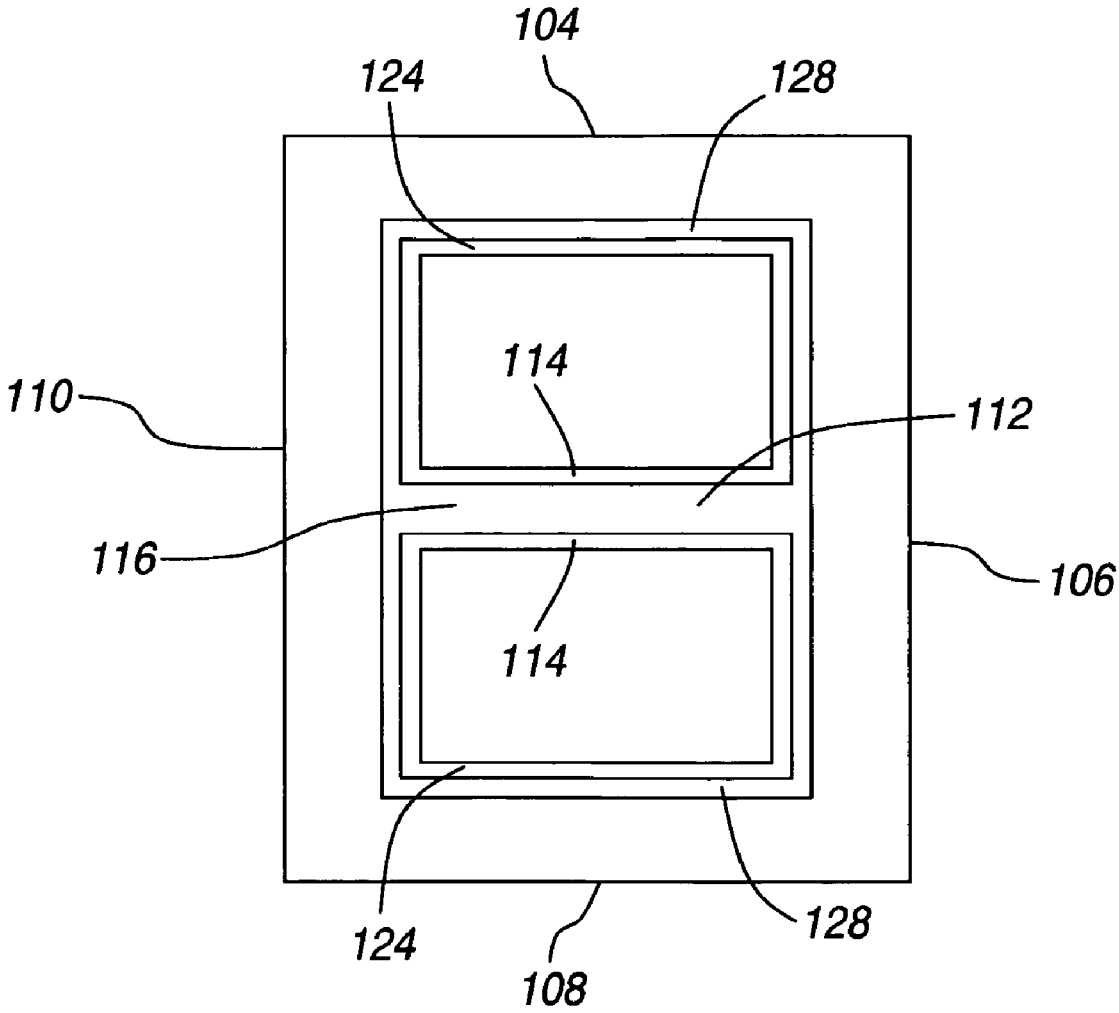
FIG. 7 is a top view of an embodiment of the present invention utilizing a single central cross member.

With reference to FIGS. 6 and 7, cross-sectional and top views of various frame assemblies utilizing a central cross member of an embodiment of the present invention in which a series of frame configurations having a central cross member for supporting multiple insulating glass units in a single frame are provided. FIG. 6 provides a cross-section of the present embodiment in which a central cross member is utilized. FIG. 7 provides a top view of the assembly illustrated in FIG. 6. Skylight frame 102 includes side sections 104, 106, 108, 110 and central cross member 112. Side sections 104, 106, 108, 110 each include stepped frame section 14 which has described above. Cross member 112 includes cross member step section which has lower step surface 114 and top surface 116. Skylight frame 102 includes stepped frame section 119 which has been set forth above. In this configuration, light-panels 118, 120 are placed in skylight frame 102 such that a peripheral section of light-panel surface 122 opposes lower step surfaces 124 and lower step surfaces 114. Larger light-panel 120 is positioned in frame 102 such that a peripheral section of surface 126 opposes upper step surfaces 128. Central portion 136 of light-panel 126 lies on and is supported by top surface 116 of cross member 112. The frame assemblies of the present embodiment allows large skylights to be fabricated and ganged together to form large panels of minimal viewing area blocked by cross members of structural supports. Because the outside surface of the skylight assembly is made from a single piece of glass the outside appearance is substantially uniform.

Figure 8A:
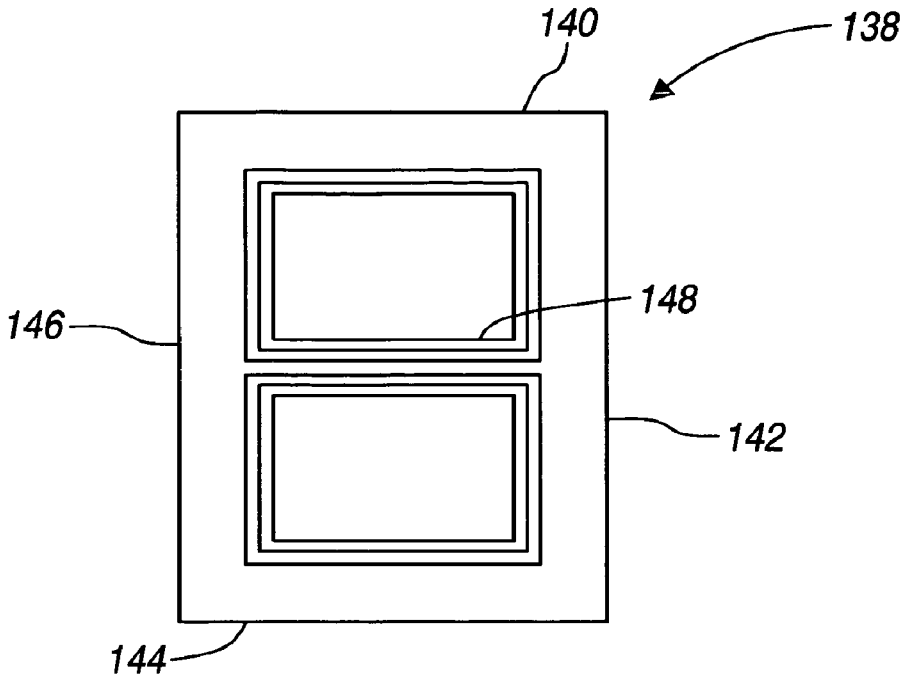
FIG. 8A is a top view of an embodiment of the present invention utilizing a two step cross member.
Figure 8B:
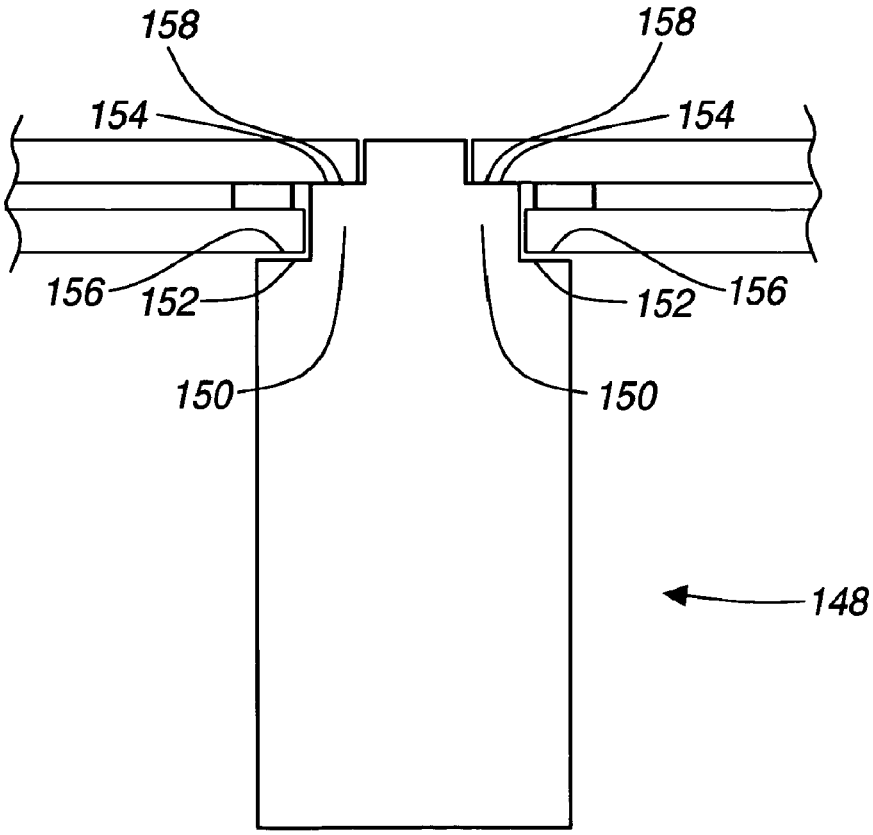
FIG. 8B is a cross-sectional view of the two step cross member illustrated in FIG. 8A.

With reference to FIGS. 8A and 8B, an alternative design for a skylight with one or more cross members is provided. FIG. 8A provides a top view of this embodiment utilizing a two step cross member, while FIG. 8B is a cross-section of the cross member used in this embodiment. In this variation, frame 138 includes sides 140, 142, 144, 146 and cross members 148. Each of sides 140, 142, 144, 146 include a stepped frame section as set forth above. FIG. 8B provides a cross-section of the two step cross member of the present invention. Cross member 148 includes stepped frame sections 150 with lower step surface 152 and upper step surface 154. Light-panel surface 156 opposes lower step surface 152 and light-panel surface 158 opposes upper step surface 154 in a similar manner as described in the discussion of FIGS. 1 and 2.

Figure 9:
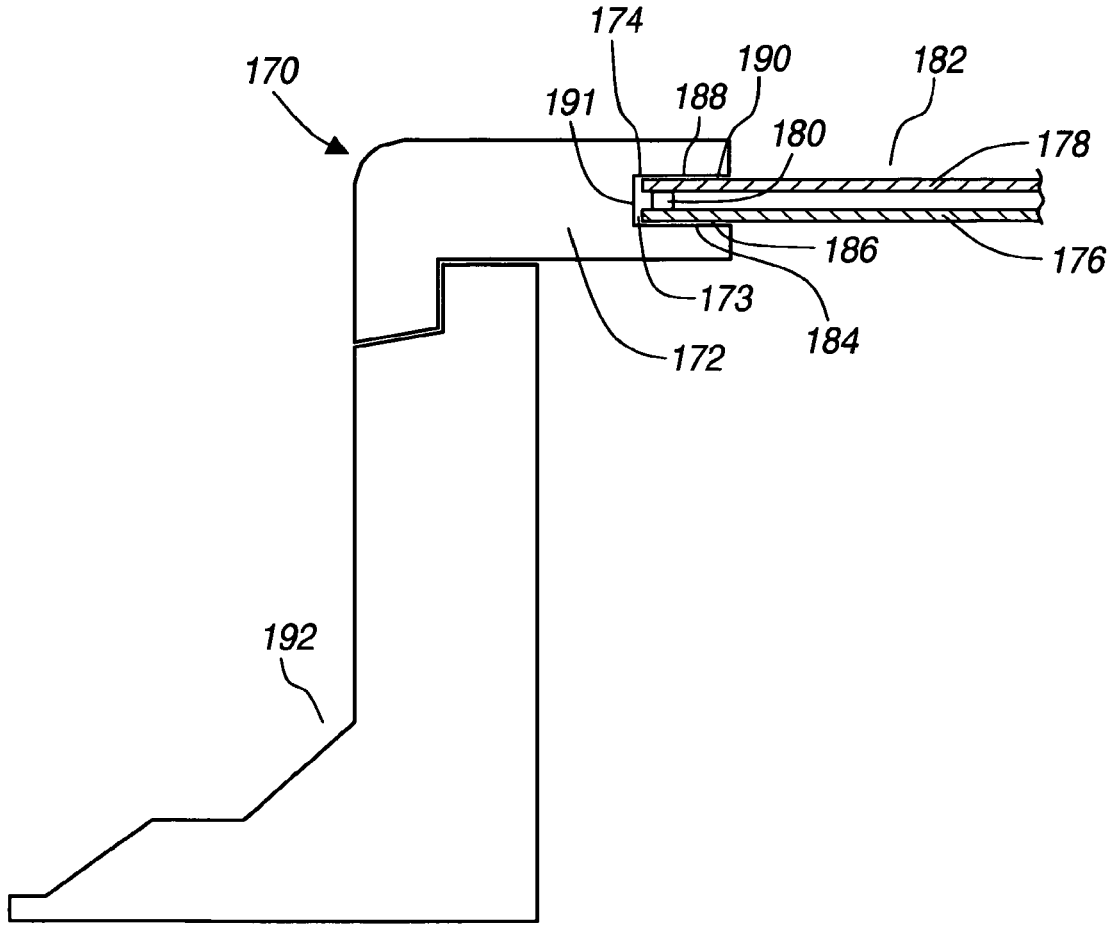
FIG. 9 is a cross-sectional view of a skylight frame-curb assembly of the present invention made by reaction injection molding.
Figure 10:
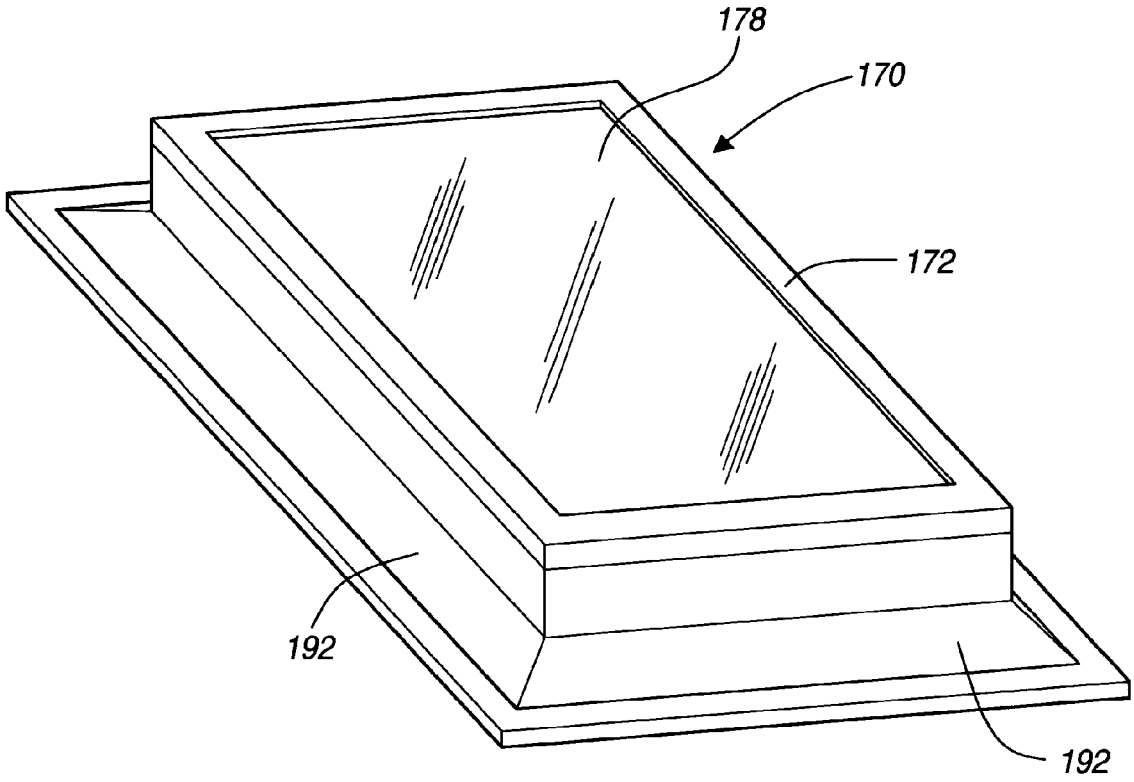
FIG. 10 is a perspective view of a skylight frame-curb assembly of the present invention made by reaction injection molding.

With reference to FIGS. 9 and 10, another embodiment of the present invention in which a skylight frame is molded about an insulating glass is provided. In this embodiment, one or more light-panels are molded into the skylight frame section during formation of the frame. In some variations, these light panels are glass panels. Preferably, this molding operation is a RIM molding process using polyurethane such as that disclosed in the '555 patent which has been incorporated by reference. Again, in such a process, an isocyanate component is reacted with an isocyanate-reactive component (i.e., a polyol) in a mold having an interior cavity complementary to the window frame. FIG. 9 provides a cross-sectional view and FIG. 10 provides a top perspective view of the skylight frame assembly of this embodiment. Skylight frame assembly 170 includes frame section 172 which has U-shaped channel 173. U-shaped channel 173 is adapted to hold one or more light-panels. Preferably, a multiglazed window unit will be held in U-shaped channel 173. Light-panel 176 and light-panel 178 are adhered together by spacer 180 to form a double glazed insulated window unit 182. Bottom surface 184 of U-shaped channel 173 opposes light-panel surface edge 186 of light-panel 176. Similarly top surface 188 of U-shaped channel 173 oppose light-panel surface edge 190 of light-panel 178. Bottom surface 184 and top surface 188 in combination with back surface 191 define U shaped channel 173. Finally, the skylight frame assembly of this embodiment optionally includes curb section 192 to facilitate placement of the skylight frame assembly on a roof.

To enhance adhesion when the light-panels are made of glass, light-panels 176, 178 should be cleaned and dried prior to molding of frame 170 around light-panels 176, 178. Moreover, the application of one or more coupling agents prior to molding is found to further enhance adhesion. More preferably, two or more coupling agents are applied to the glass surfaces prior to molding of the skylight frame. Silane coupling agents include vinylsilanes, acryloxy compounds, epoxysilanes, aminosilanes, and organosilane esters. Vinylsilane coupling agents include, for example, vinyltricolosilane, vinyl tris(β-methoxyethoxy) silane, vinyltriethoxysilane. An example of an acryloxy coupling agent is 3-metacryloxypropyl-trimethoxysilane. Examples of epoxysilane coupling agents include for example, β-(3,4 epoxycyclohexyl)-ethyltrimethoxysilane, γ-glycidoxypropyl-trimethoxysilane, and γ-glycidoxypropyl-methylidiethoxysilane. Examples of aminosilane coupling agents include for example, N-β (aminoethyl)-γ-aminopropyl-trimethoxysilane, N-β (aminoethyl)-γ-aminopropyl-methyldimethoxysilane, 3-aminopropyl-triethoxysilane, N-phenyl-γ-aminopropyl-trimethoxysilane. An example of an organosilane ester is methyl triethoxysilane. Other silane coupling agents are γ-mercaptopropyl-trimethoxysilane and γ-chloropropyl-trimethoxysilane. Silane coupling agents are commercially available from Union Carbide Corporation and Mitsubishi International Corporation. In another variation of this embodiment, adhesion of the glass surfaces to the RIM formed frame is formed by treatment of the glass surfaces with one or more primers. Useful primers include one or more of the following components: organosilanes, polyurethanes, polyesters, pigments, and solvents. Examples of suitable primers include Betaseal™ 43518 Glass Primer and Betaseal™ 43520A Glass Primer commercially available from Dow Chemical Company. Betaseal™ 43518 Glass Primer is a proprietary composition which includes toluene, methyl alcohol, and an organosilane. Betaseal™ 43520A Glass Primer is a proprietary composition which includes toluene, methyl ethyl ketone, carbon black, n-butyl acetate, potassium oxide, xylene, polyurethane, polyester, and an organosilane. Typically, the glass is first treated with Betaseal™ 43518 Glass Primer and then Betaseal™ 43520A. It is readily apparent that these primers and in particular the Betaseal™ 43518 Glass Primer and Betaseal™ 43520A contain a number of components that improve adhesion of the RIM molded frame to the glass panels.

Figure 11A:
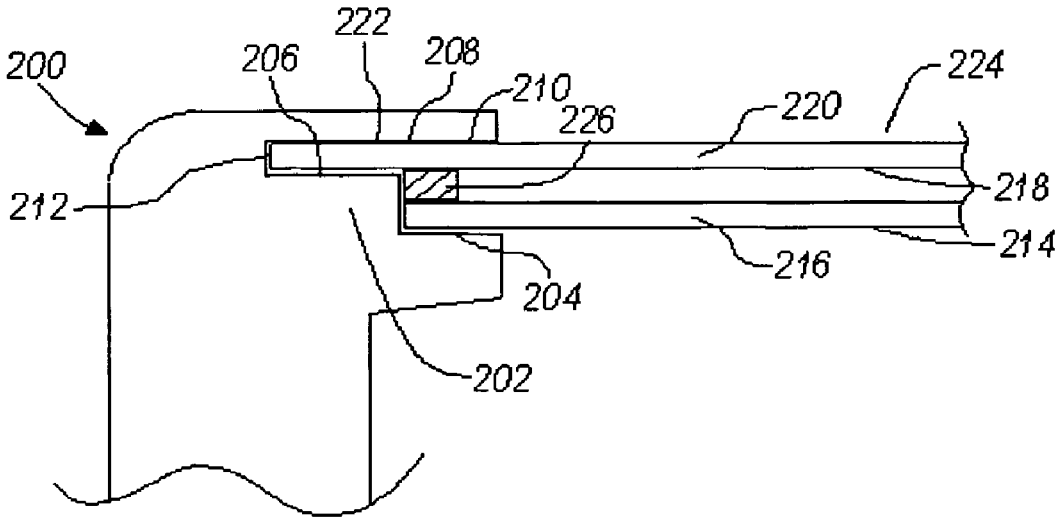
FIG. 11A is a cross-section of a skylight frame-curb assembly of the present invention made by reaction injection molding that has a stepped frame section.
Figure 11B:
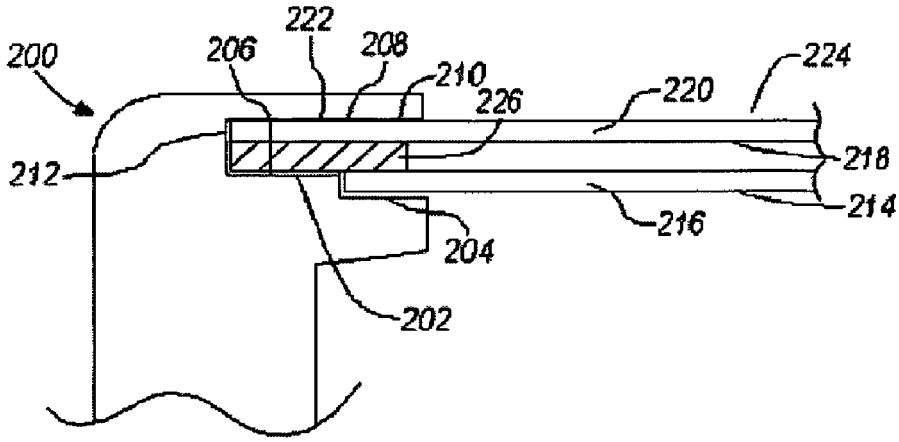
FIG. 11B is a cross-section of a skylight frame-curb assembly of the present invention made by reaction injection molding that has a stepped frame section with a spacer extending beyond the edge of the lower light-panel.

FIGS. 11A and 11B provide cross-sectional views of skylight frames with an embedded insulating glass unit having a stepped frame section. With reference to FIG. 11A, skylight frame section 200 includes stepped frame section 202. Stepped frame section 202 includes lower step surface 204, upper step surface 206, upper channel surface 208. Moreover, skylight frame section 200 includes channel 210 which is defined by upper step surface 206, back surface 212, and upper channel surface 208. Lower step surface 204 opposes light-panel surface 214 of light-panel 216 and upper step surface 206 opposes light-panel surface 218 of light-panel 220. Similarly, upper channel surface 208 opposes light-panel surface 222 of light-panel 220. As set forth above, light-panel 216 and light-panel 220 can be combined together in insulated glass unit 224 with a spacer 226. The skylight frame design of this embodiment is advantageously molded around light-panels 216, 220. The preferred method of molding this embodiment is RIM using polyurethane as set forth above and in the '555 patent. Again, adhesion is enhanced when the panels are made of glass by cleaning and drying light-panels 216, 220 prior to molding skylight frame 200 followed by application of one or more coupling agents. The preferred coupling agents are the same as those set forth above. Alternatively, one or more primers are used to enhance adhesion as set forth above. With reference to FIG. 11A an embodiment where spacer 226 extends past the edge of light-panel 216 is provided. In this variation, lower step surface 204 opposes light-panel surface 214 of light-panel 216 and upper step surface 206 opposes a lower surface of spacer 226. Again, upper channel surface 208 opposes light-panel surface 222 of light-panel 220.

Figure 12:
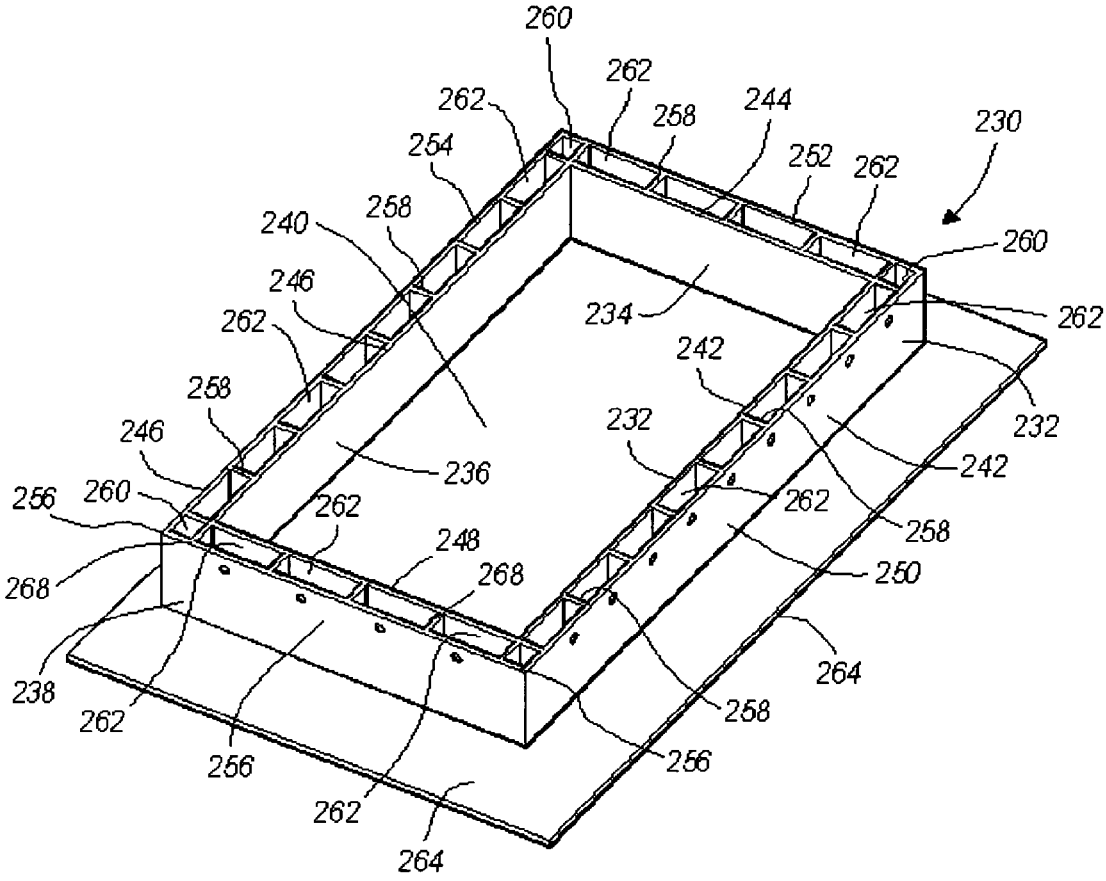
FIG. 12 is a top perspective view of the injection molded skylight curb unit of the present invention.
Figure 13:
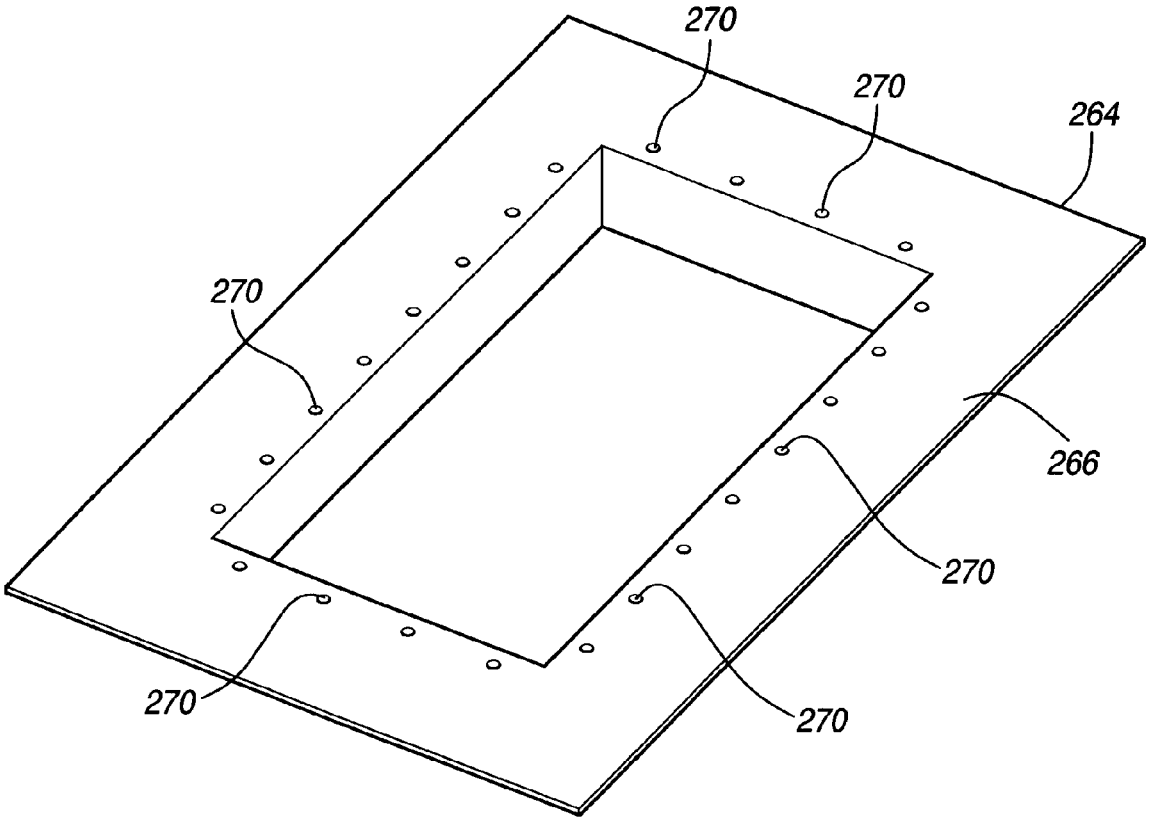
FIG. 13 is a bottom perspective view of the injection molded skylight curb unit of the present invention.

With reference to FIGS. 12 and 13, a skylight curb unit adaptable to a skylight frame is illustrated. FIG. 12 is a top perspective view and FIG. 13 is a bottom perspective view of the skylight curb unit of this embodiment. The skylight curb unit is preferably made of a plastic or rigid polymer by injection molding or RIM. Skylight curb unit 230 includes curb sides 232, 234, 236, 238 that define substantially rectangular or square opening 240. Curb sides 232, 234, 236, 238 include interior walls 242, 244, 246, 248 and exterior walls 250, 252, 254, 256. Rigidity is provided to the curb unit by rib network that includes ribs 258 that connect to interior walls 242, 244, 246, 248 and exterior walls 250, 252, 254, 256. The rib network in conjunction with interior walls 242, 244, 246, 248 and exterior walls 250, 252, 254, 256 defines slots 260, 262. Flexible apron 264 extends outwardly from curb sides 232, 234, 236, 238 to provide bottom surface 266 that is adapted to be placed on a rooftop. Top surface 268 of curb unit 230 is adapted to receive a skylight frame unit. Optionally, a gasket and/or a sealant is placed on top surface 268 for this purpose. Bottom surface 266 includes a plurality of bolt holes 270 to receive bolts used to attach the skylight curb unit to a roof. These bolts are passed through slots 260, 262 for this purpose. Moreover, apron 264 may be flashed to a roof by methods known to those in the art of skylight installation. The curb unit of this embodiment is preferably made by injection molding with a thermoplastic resin. Suitable thermoplastic resins include, for example, polyvinylchloride, polyethylene, polypropylene, or nylon.

Figure 14:
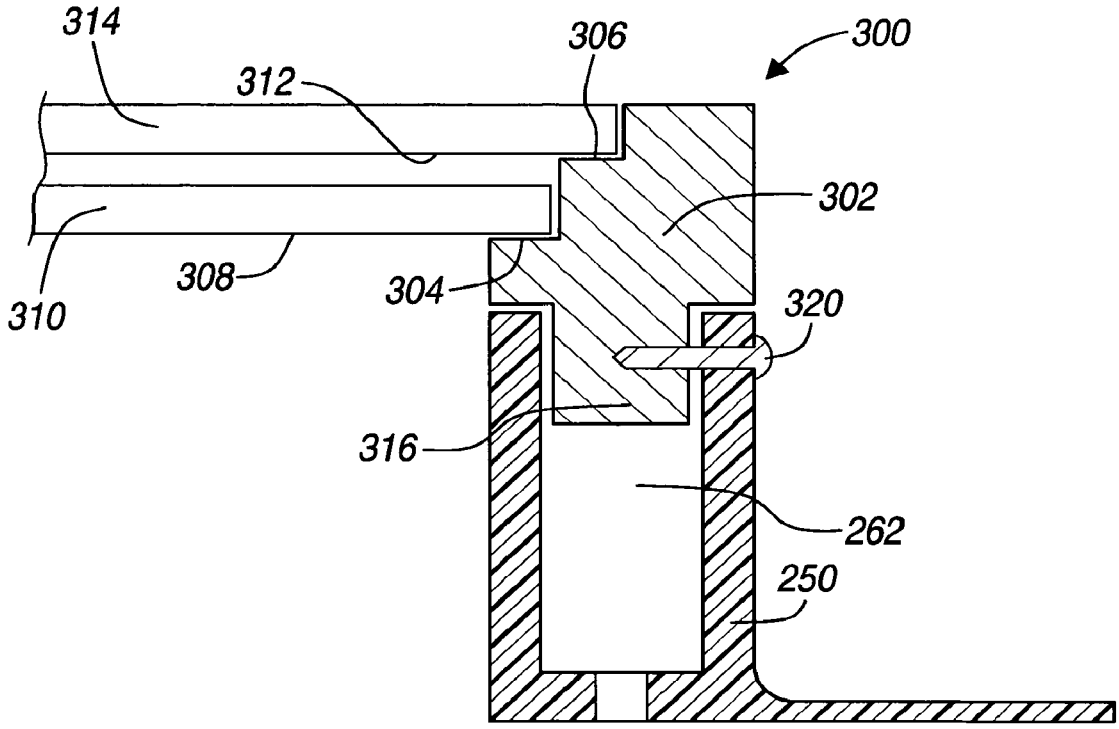
FIG. 14 is cross-sectional view of an integrated skylight frame unit with a bottom cap section inserted into the skylight curb unit of FIGS. 12 and 13.
Figure 15:
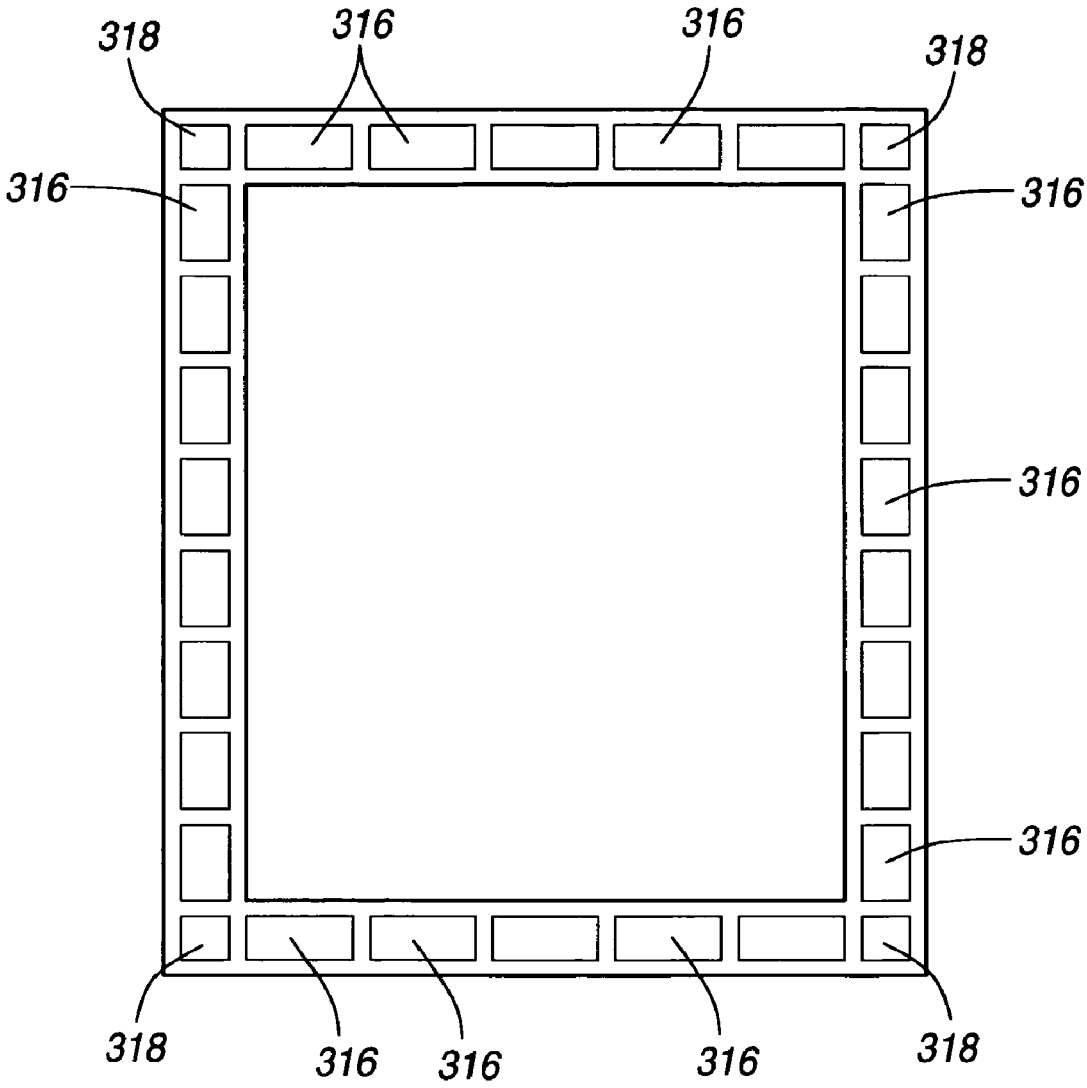
FIG. 15 is a bottom view of an integrated skylight frame unit with a bottom cap section.

With reference to FIGS. 14 and 15, a skylight frame unit adapted be attached to the curb unit of FIGS. 12 and 13 is described. FIG. 14 is a cross-sectional view of the skylight frame unit with a bottom cap section inserted into the skylight curb unit of FIGS. 12 and 13. FIG. 15 is a bottom view of the skylight frame unit of this embodiment. Skylight frame 300 includes stepped frame section 302 for receiving a window assembly. The details of stepped frame section 302 are the same as those set forth above for FIGS. 1 and 2. Stepped frame section 302 includes lower step surface 304 and an upper step surface 306. In a variation, lower step surface 304 is adapted to receive light-panel surface 308 of light-panel 310 and upper step surface 306 is adapted to receive light-panel surface 312 of light-panel 314 (with or without a spacer interposed between light-panel surface 312 and upper step surface 306.) Skylight frame 300 also includes insert sections 316 and 318 which are adapted to slide into slots 260, 262 of the skylight curb unit described in FIGS. 12 and 13. Skylight frame 300 is held in place by screw 320 which passes through wall 250 into insert section 316. Alternatively, a pin may be used instead of screw 320.

In still another embodiment of the present invention, a method of forming the skylight frame described above in FIGS. 1-3 is provided. The method of this embodiment comprises extruding a plastic channel with a stepped frame section integral to the plastic channel having a lower step surface and upper step surface; cutting the plastic channel to form a first frame side, a second frame side, a third frame side, and a fourth frame side; and combining the first frame side, the second frame side, the third frame side, and the fourth frame side together to form the skylight frame. The details of the stepped frame section and curb section if present are the same as set forth above for FIGS. 1-4. Moreover, the plastic channel preferably comprises a plastic selected from the group consisting of polyvinylchloride, polyethylene, polypropylene, or nylon.

Figure 16A:
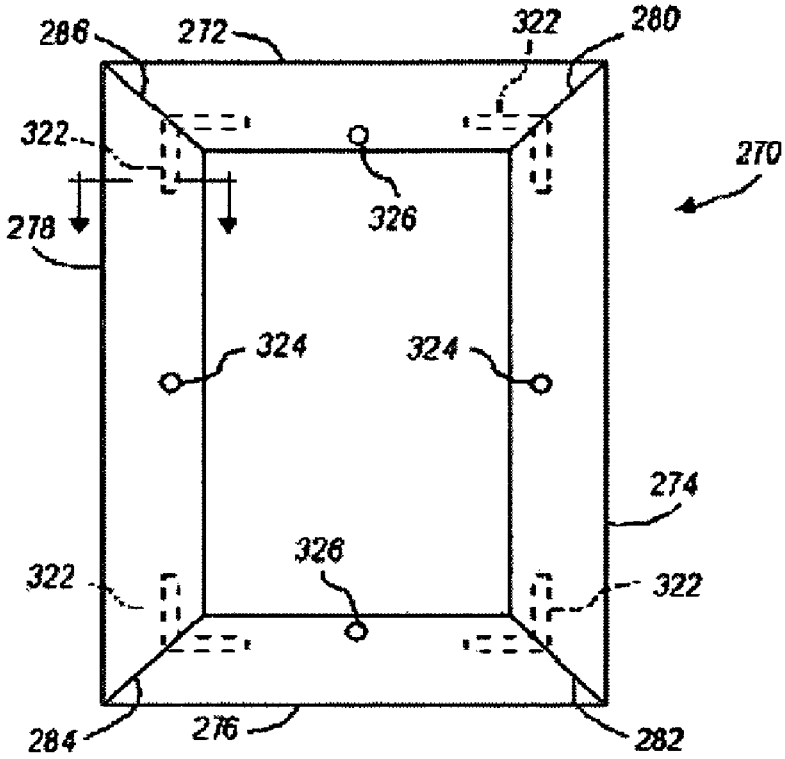
FIG. 16A is a bottom view of a skylight frame-curb assembly constructed from four mitered sides.
Figure 16B:
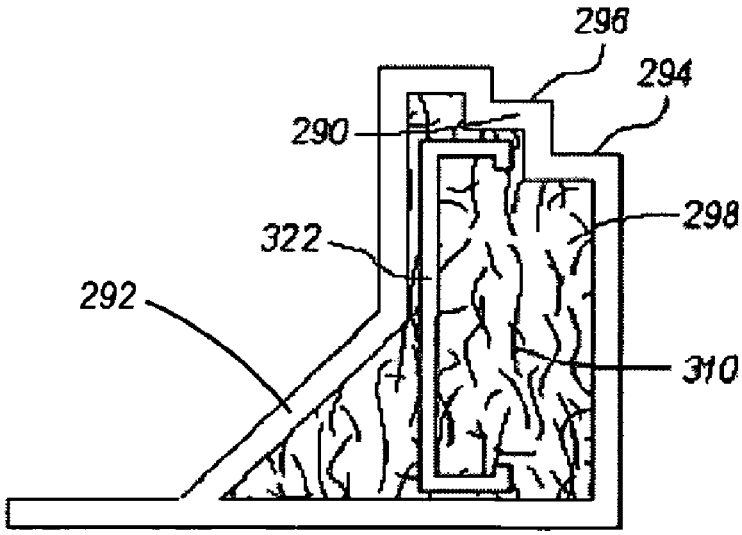
FIG. 16B is a cross-sectional through one of the sides of the skylight frame-curb assembly described by FIG. 16A.

With reference to FIGS. 16A and 16B, a skylight frame assembly constructed from four sides is illustrated. FIG. 16A is a bottom view of a skylight frame-curb assembly constructed from four sides, while FIG. 16B is a cross-section through one of the sides when the skylight frame assembly includes a curb section. Skylight frame-curb assembly 270 is assembled from sides 272, 274, 276, 278 which have been cut from an extruded channel. Sides 272, 274, 276, 278 are mitered together as beveled joints 280, 282, 284, 286. Sides 272, 274, 276, 280 include frame step section 290 and curb section 292. Frame step section 290 includes lower step surface 294 and upper step surface 296 which is similar to the frame step section of FIGS. 1-3. Moreover, sides 272, 274, 276, 278 include hollow cavity 298. Optionally, angular inserts 322 are placed within sides 272, 274, 276, 278 as the sides are joined together. These inserts provide rigidity and support to the skylight frame-curb assembly and may extend into hollow cavity 298 for any length desired. Beveled joints 280, 282, 284, 286 are welded together to form a leak tight seal. Suitable processes for this welding include, for example, conventional plastic welding with a heat source and a plastic welding rod, laser welding, and solvent bonding. Optionally, hollow cavity 298 is filled with foamed plastic 310 which is introduced into hollow cavity 298 through inlet holes 324. Vent holes 326 provide a venting path while the foamed plastic is added. The assembly of the skylight frame-curb assembly set forth in this embodiment may be applied the fabrication of the sky-light curb assembly of FIGS. 1-3. Similarly, the present embodiment may be applied to the fabrication of the skylight frame of FIG. 4 except that the four sides do not have an integral curb section.

In still another embodiment of the present invention, a method of forming the skylight frame-curb assembly described above in FIG. 5 is provided. The method of this embodiment comprises extruding a plastic U-shaped channel with a stepped frame section integral to the plastic channel having a lower step surface and upper step surface. The details of the stepped frame section and the cross-section of the U-shaped channel are the same as set forth above for FIG. 5.

Figure 17:
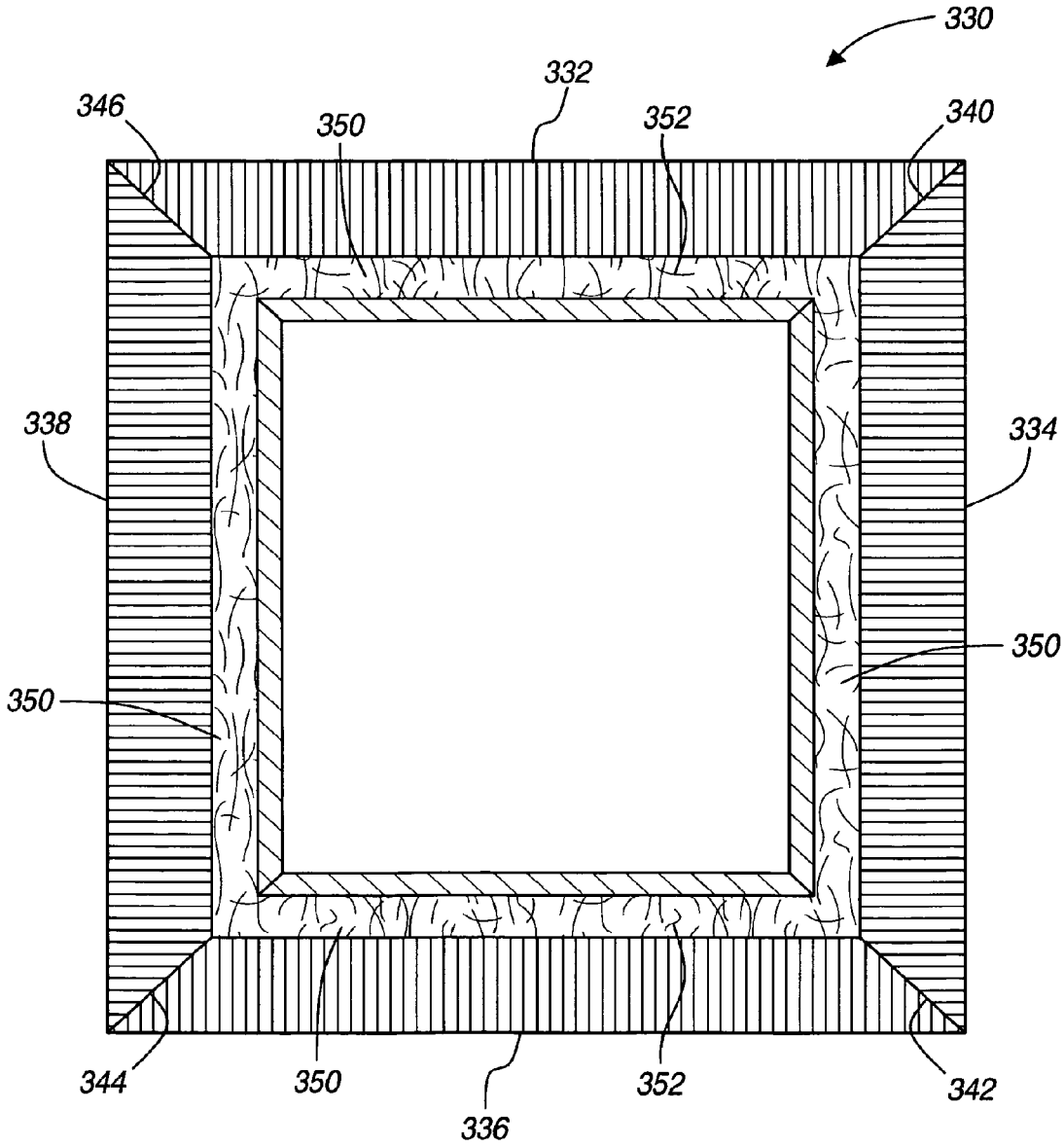
FIG. 17 is a bottom view of a skylight frame-curb assembly constructed from four sides with a with a U-shaped channel.

With reference to FIG. 17, a bottom view of a skylight frame assembly with a U-shaped channel constructed from four sides is illustrated. Skylight frame-curb assembly 330 is assembled from sides 332, 334, 336, 338 which have been cut from an extruded U-shaped channel. Sides 332, 334, 336, 338 are mitered together as beveled joints 340, 342, 344, 346. Sides 332, 334, 336, 338 includes a stepped frame section and curb section (not shown) as set forth for FIG. 5. Sides 332, 334, 336, 338 include U-shaped trough 350. Beveled joints 340, 342, 344, 346 are welded together to form a leak tight seal. Suitable processes for this welding include, for example, conventional plastic welding with a heat source and a plastic welding rod, laser welding, and solvent bonding. Optionally, U-shaped trough 350 is filled with foamed plastic 352.

Figure 18:
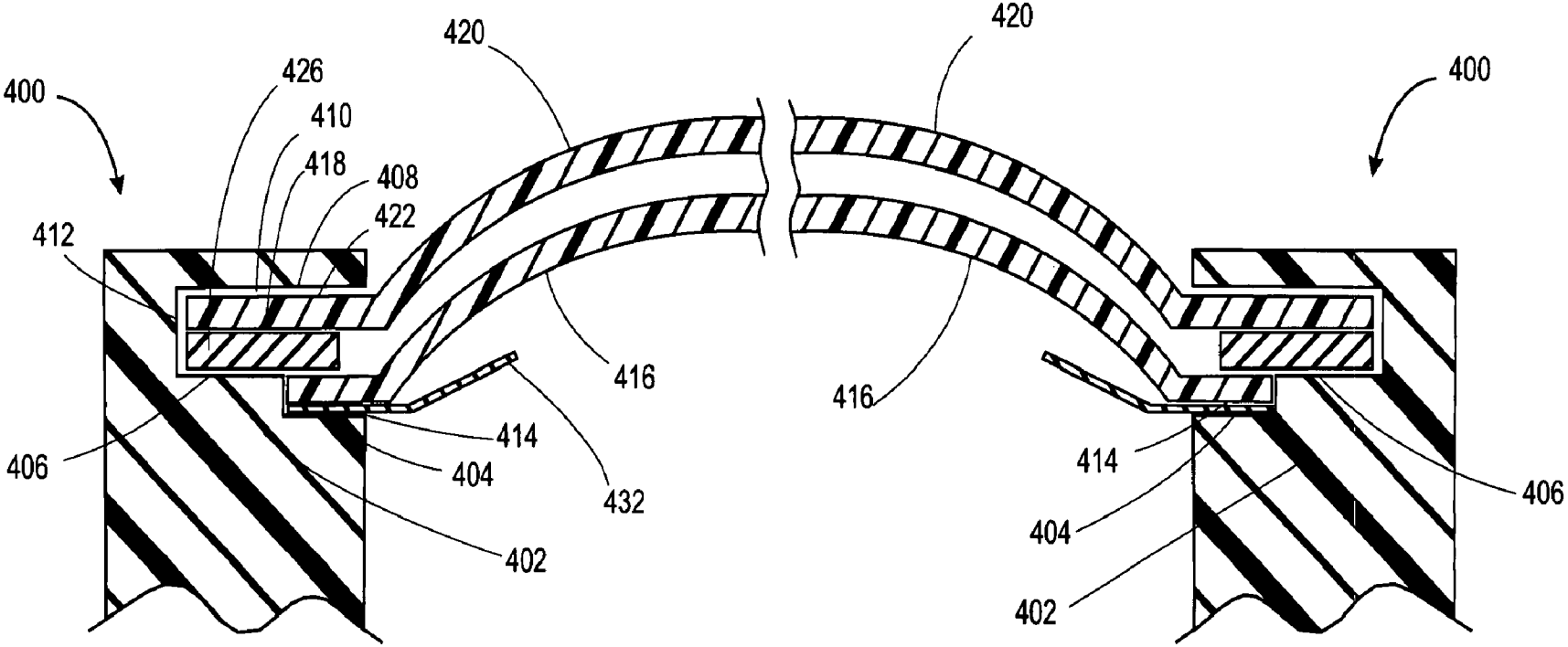
FIG. 18 is a cross-sectional view of a skylight frame with an embedded curved insulating glass unit having a stepped frame section.

With reference to FIG. 18, a cross-sectional view of a skylight frame with an embedded curved insulating glass unit having a stepped frame section is provided. Skylight frame section 400 includes stepped frame section 402. Stepped frame section 402 includes lower step surface 404, upper step surface 406, and upper channel surface 408. Moreover, skylight frame section 400 includes channel 410 which is defined by upper step surface 406, back surface 412, and upper channel surface 408. Lower step surface 404 opposes light-panel surface 414 of curved light-panel 416 and upper step surface 406 opposes a surface of spacer 426. (In an analogous manner to variations set forth above, spacer 426 may not extend over upper step surface 404. Instead, upper step surface 406 opposes light-panel surface 418 of curved light-panel 420.) Similarly, upper channel surface 408 opposes light-panel surface 422 of light-panel 420. As set forth above, curved light-panel 416 and curved light-panel 420 are optionally combined together in insulated glass unit 424 with spacer 426. FIG. 18 demonstrates curved light-panels 416, 420 each including an outer peripheral region that is flat and a central curved region. In a variation, skylight frame section 400 includes drip curb 432 (see below). In this variation, lower step surface 404 and light panel surface 414 each oppose a surface of drip curb 432. It should be appreciated that in variations in which the light-panels do not have such a peripheral flat region, stepped frame section 400 may be angled to mate with the edge detail of the light-panels. The skylight frame design of this embodiment is advantageously molded around a peripheral region of curved light-panels 416, 420. The preferred method of molding this embodiment is RIM using polyurethane. Again, adhesion is enhanced when glass panels are used by cleaning and drying glass plates 416, 420 prior to molding skylight frame 400 followed by application of one or more coupling agents. The preferred coupling agents are the same as those set forth above. Alternatively, one or more primers are used to enhance adhesion as set forth above.

Figure 19:
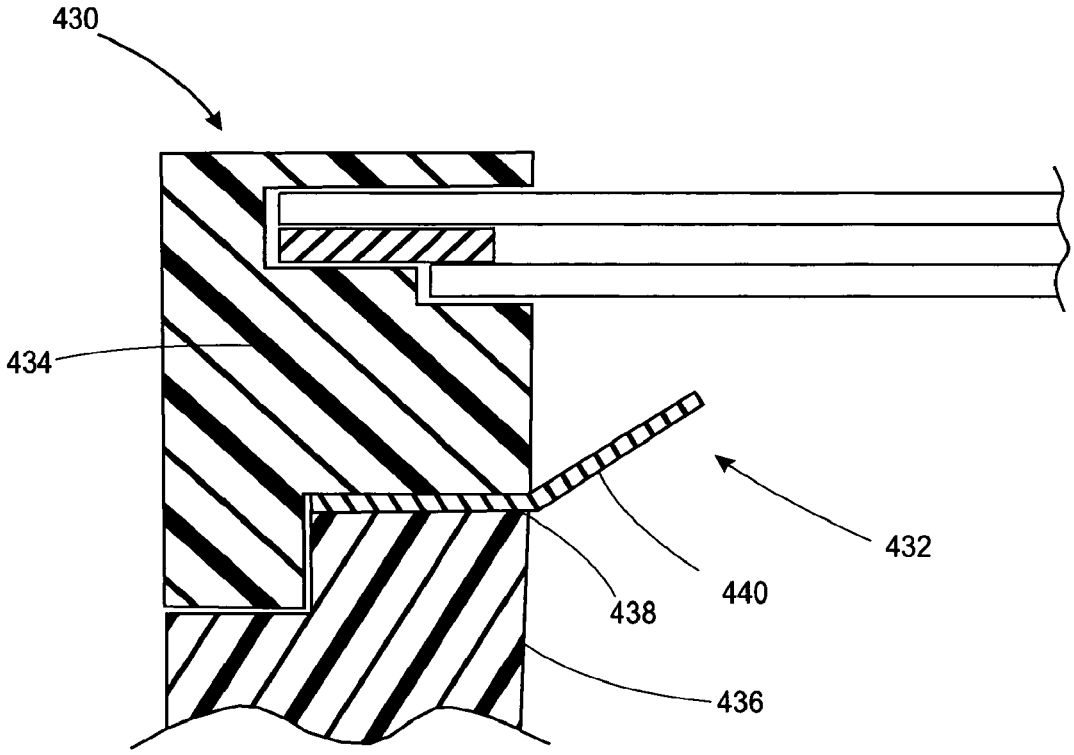
FIG. 19 is a cross-sectional view of a skylight which includes both the stepped section of the present invention and a drip curb.
Figure 20:
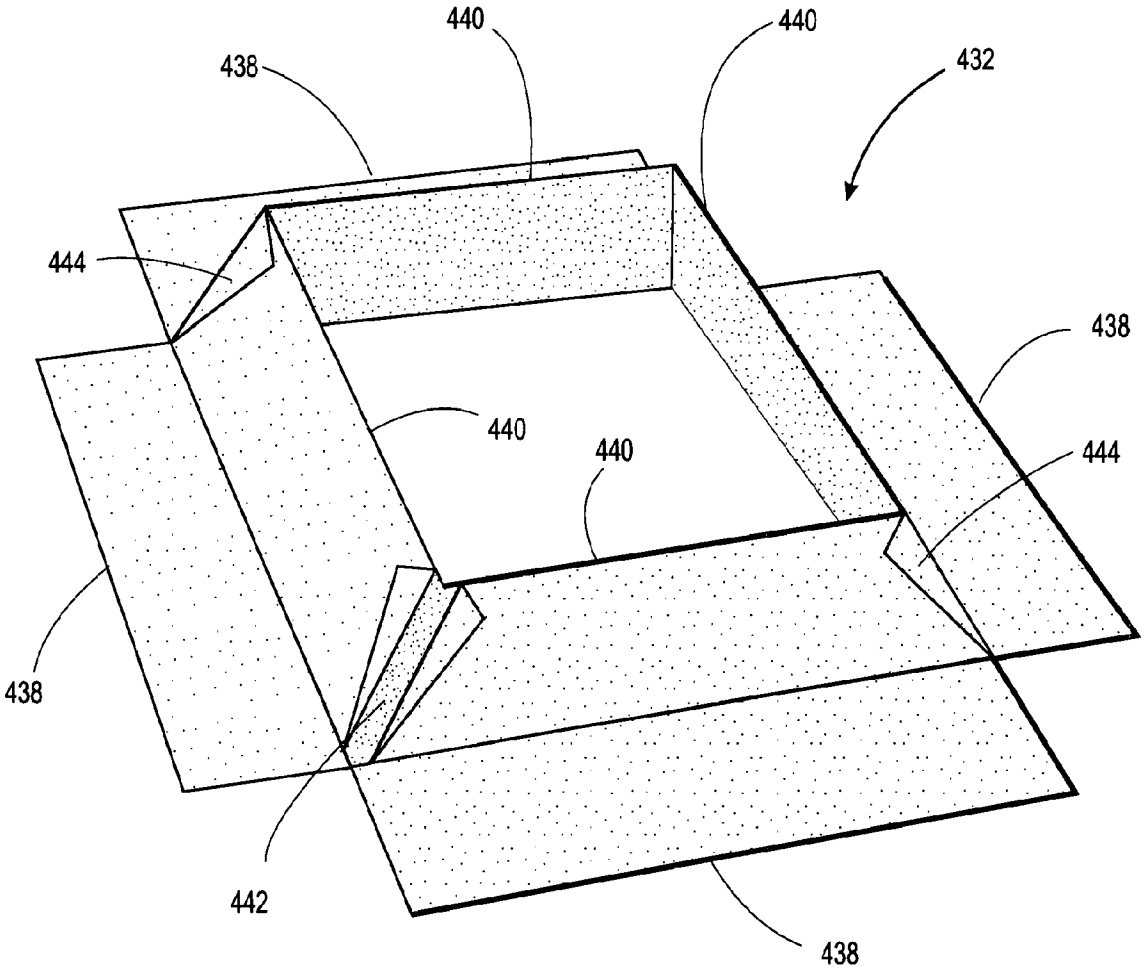
FIG. 20 is a perspective view of a drip frame formed from a thin metallic rectangular strip.

With reference to FIG. 19, a cross-sectional view of a skylight which includes both the stepped section of the present invention and a drip curb is provided. Drip curbs are used in skylight designs to catch any condensation that may form on a skylight. Skylight 430 includes drip curb 432 which is sandwiched between skylight frame 434 and curb 436. Drip curb 432 includes flat section 438 and an upwardly angled section 440. The drip curb may extend about the entire frame periphery or in the case of a flat skylight mounted on an include roof along the lowermost edge. FIG. 20 provides a perspective view of a drip frame formed from a thin metallic rectangular strip. A thin angle-shaped cross section metal strip is notched at various positions and then bent to form a rectangular shape frame of proper size to be positioned between skylight frame 434 and curb 436. The corners of the metal strip are folded like rapping paper in corners 442 form angled section 440. The ends of the metal strip are attached together and sealed along seam 444.

Figure 21:
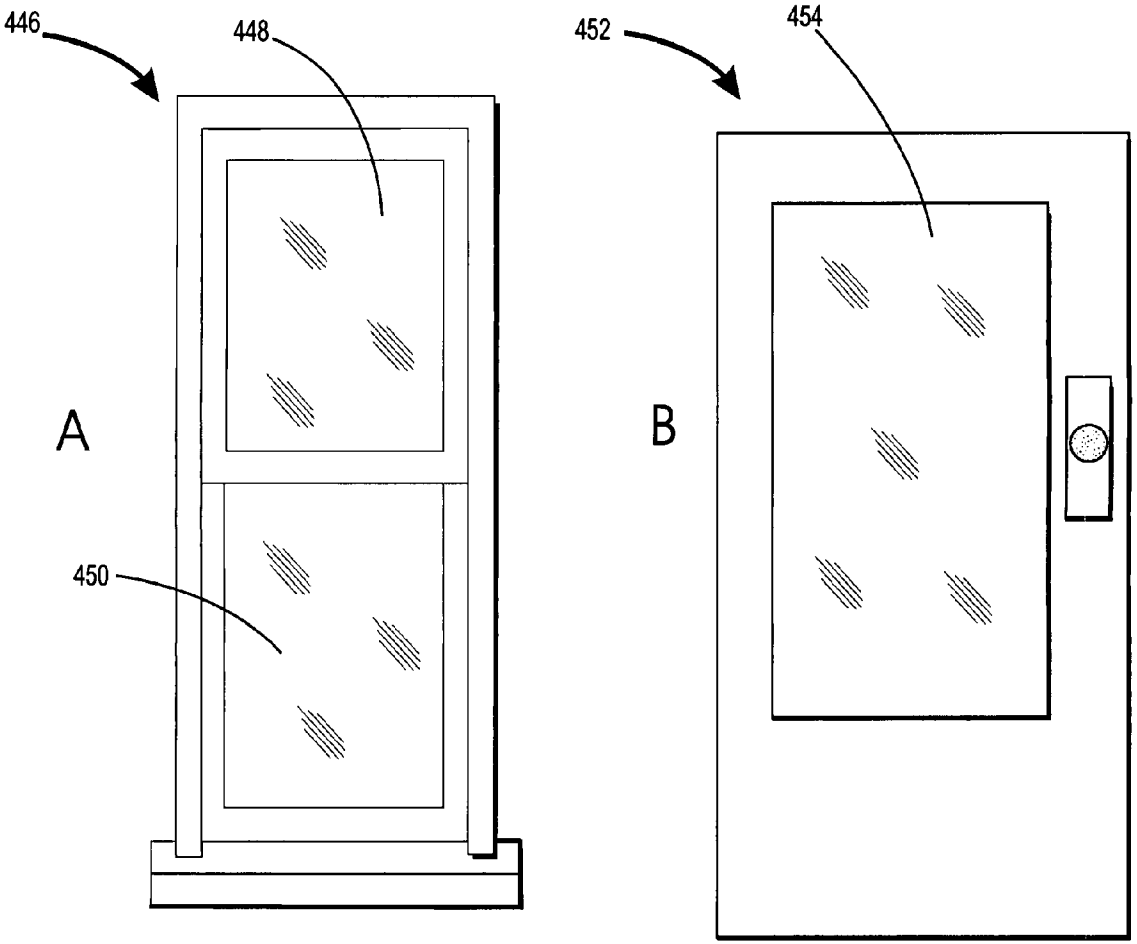
FIG. 21A is a schematic of a conventional window that includes the window frame section of the invention.
FIG. 21B is a schematic of a door that includes the window frame section of the invention.

As set forth above, the window frame section of the present invention is not only useful in skylight application. The window frame section and the step frame sections set forth above may be used in any assembly that includes a window such as doors or conventional window units. FIG. 21A provides a schematic of a conventional window that includes the window frame section of the invention. Window unit 446 includes window sections 448, 450. Each of window sections 448, 450 include the window frame section of the invention. Similarly, FIG. 21B provides a schematic of a door that includes the window frame section of the invention. Window unit 452 includes window section 454. Again, window section 454 includes the window frame section of the invention.

Figure 22:
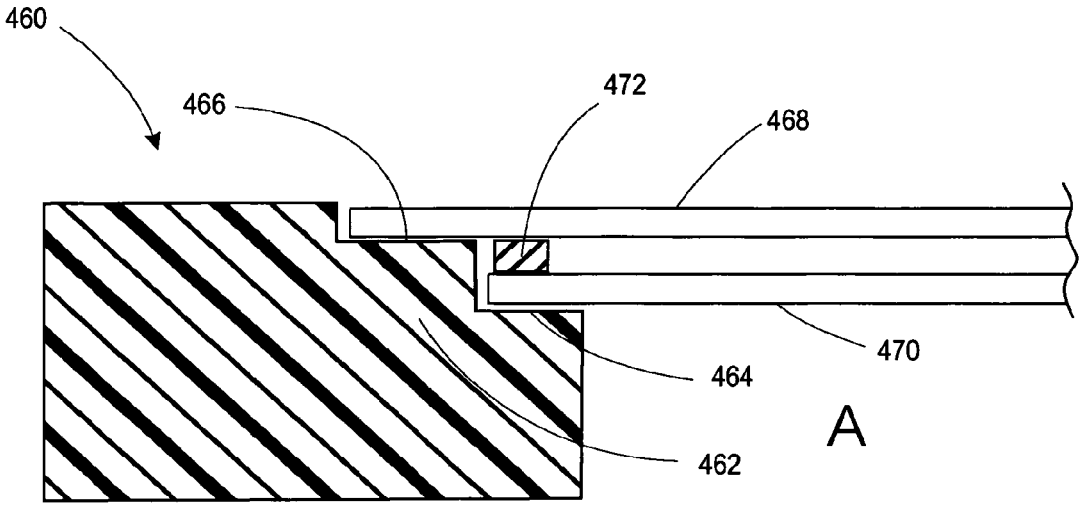
FIG. 22A is a cross-section illustrating the inclusion of the window frame section of the invention in conventional window or door applications in which the spacer does not extend over the upper step surface.
FIG. 22B is a cross-section illustrating the inclusion of the window frame section of the invention in conventional window or door applications in which the spacer extends over the upper step surface.
Figure 22:
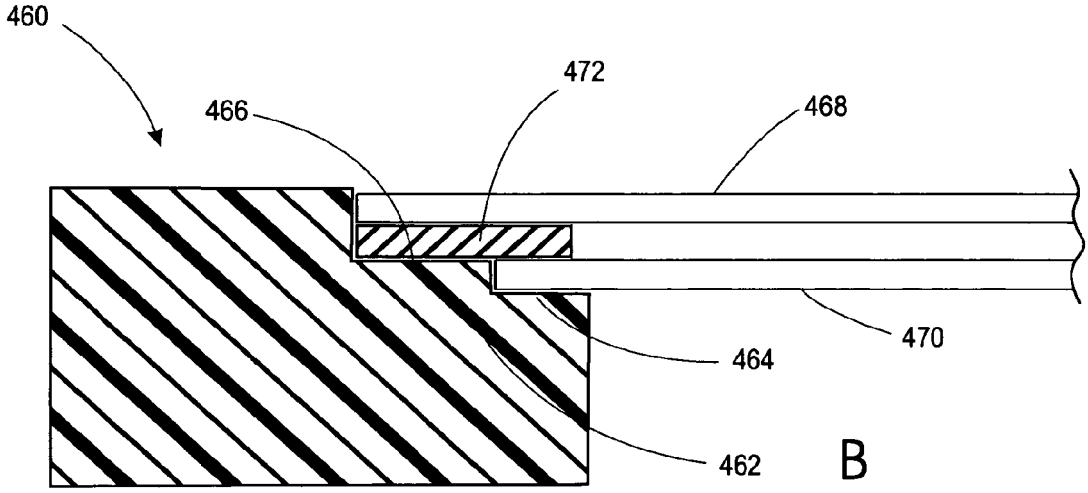

With reference to FIGS. 22A and 22B idealized cross-sections illustrating the inclusion of the window frame section of the invention in conventional window or door applications is provided. Window frame section 460 includes stepped section 462 which includes lower step surface 464 and upper step surface 466. Stepped section 462 is adapted to receive light-panels 468, 470 in the same manner as set forth above. FIG. 22A provides a variation in which spacer 472 does not extend over upper step surface 466 while FIG. 22B provides an illustration of a variation in which spacer 472 does extend over upper step surface 466.

Figure 23:
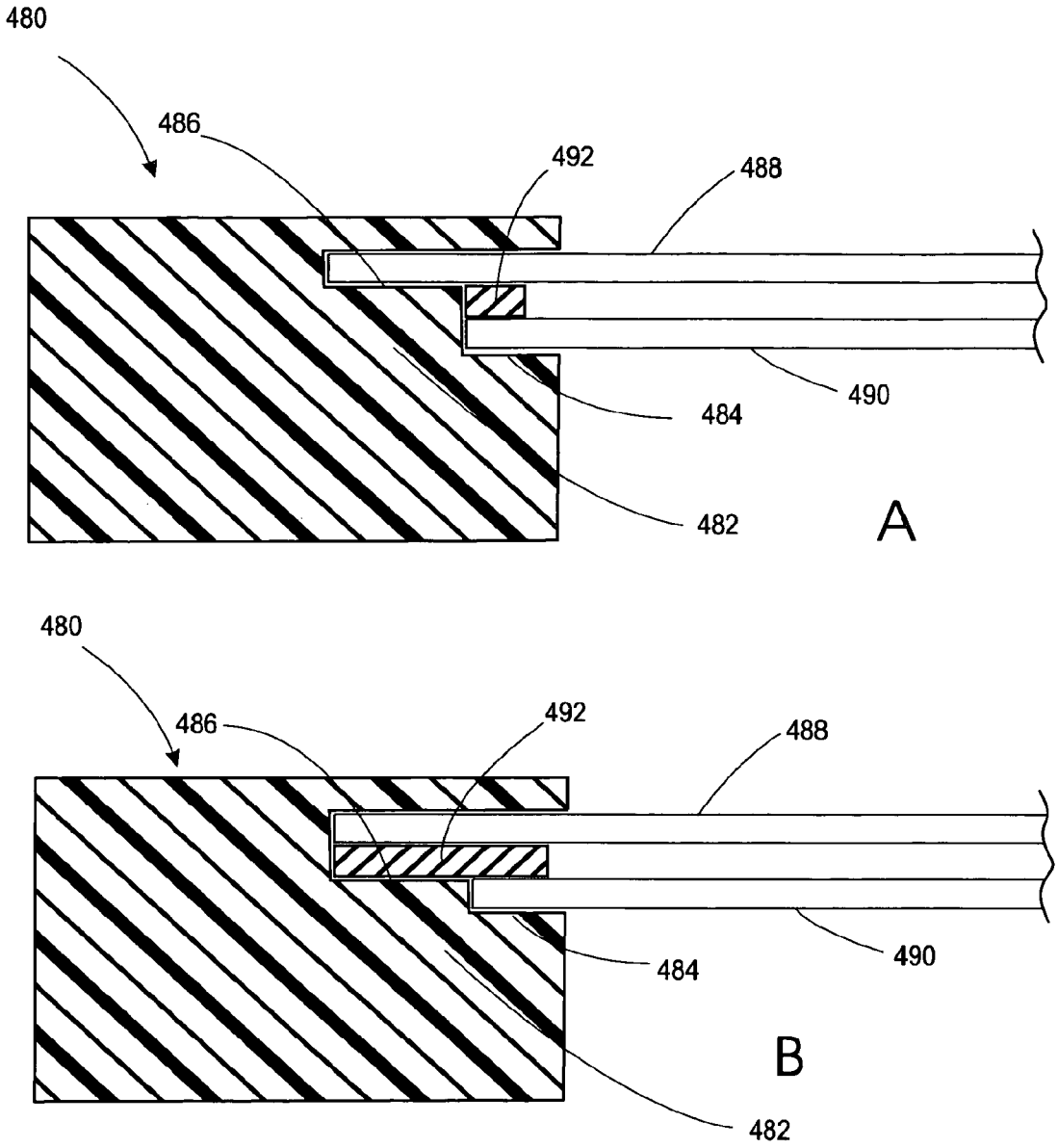
FIG. 23A is a cross-section illustrating the inclusion of the window frame section of the invention in conventional window or door applications in which glass sheets are molded into the frame section and in which the spacer does not extend over the upper step surface.
FIG. 23B is a cross-section illustrating the inclusion of the window frame section of the invention in conventional window or door applications in which glass sheets are molded into the frame section and in which the spacer extends over the upper step surface.

With reference to FIGS. 23A and 23B idealized cross-sections illustrating the inclusion of the window frame section of the invention in conventional window or door applications in which light-panels are molded into the frame section. In some variations, these light panels are glass panels. Window frame section 480 includes stepped section 482 which includes lower step surface 484 and upper step surface 486. Stepped section 482 is adapted to receive light-panels 488, 490 in the same manner as set forth above. Moreover, in this variation light-panels are molded into window frame section 480 by the RIM process as explained above. FIG. 23A provides a variation in which spacer 492 does not extend over upper step surface 486 while FIG. 23B provides an illustration of a variation in which spacer 492 does extend over upper step surface 486.

Figure 24:
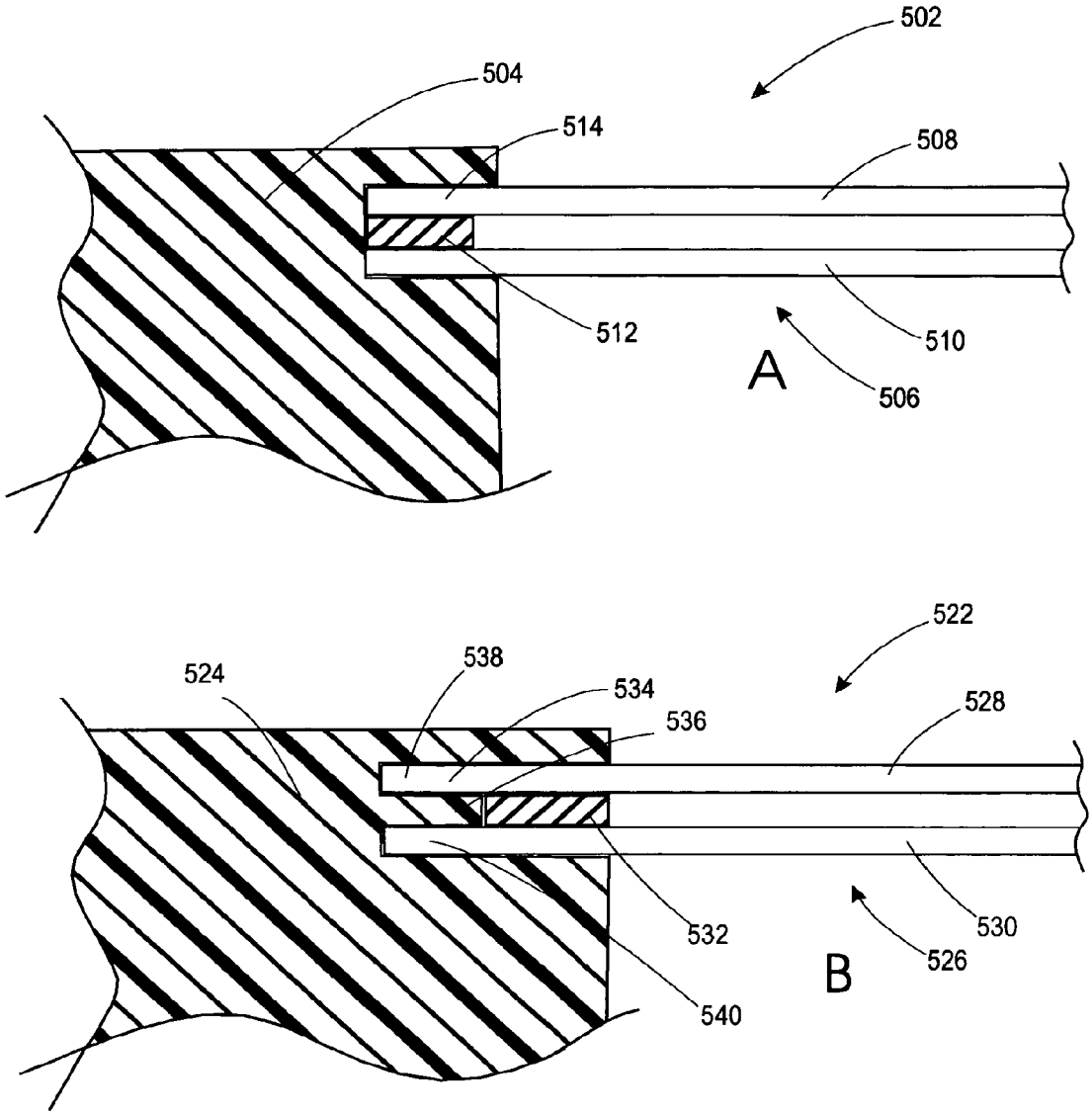
FIG. 24A is a cross-section illustrating an embodiment of the invention in which the periphery of a compound window is embedded in polyurethane.
FIG. 24B is a cross-section illustrating an embodiment of the invention in which the periphery of a compound window is embedded in polyurethane.
FIG. 24C is a cross-section illustrating an embodiment of the invention in which a single light-panel is embedded in polyurethane.
Figure 24:
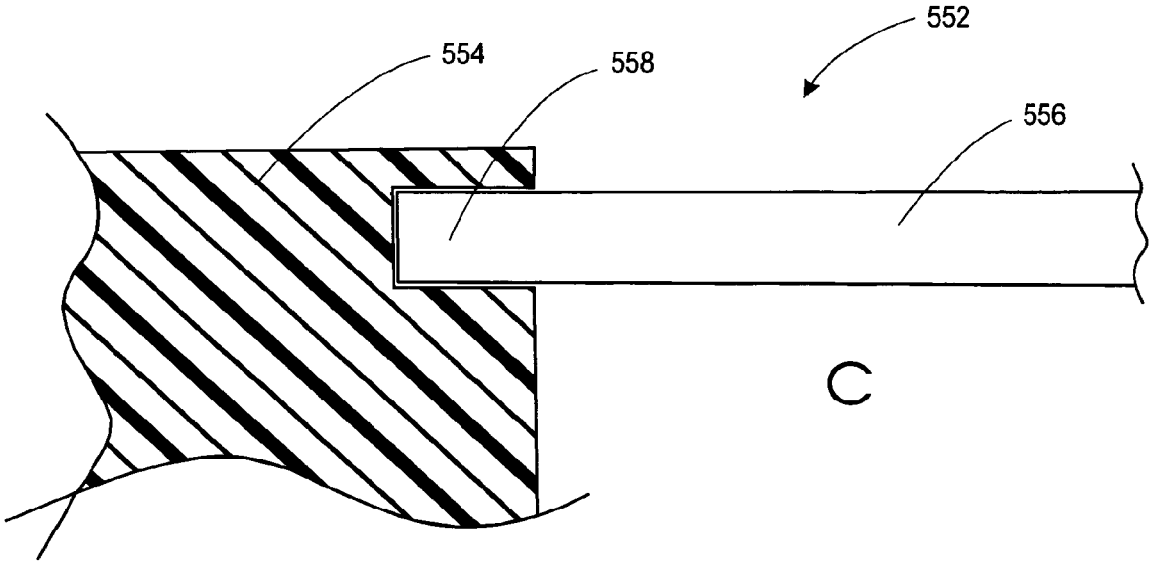

With reference to FIGS. 24A, 24B, and 24C cross-sections illustrating an embodiment of the invention in which the peripheral edges of various light-panel constructions are embedded in a polyurethane resin. The embedding of a light construction utilizing the stepped frame construction of the invention is set forth above. This embodiment represents a generalization of that process. In FIG. 24A, light construction 502 includes frame section 504 with surrounds compound window 506. Compound window 506 includes transparent lights 508, 510 and spacer 512. Frame section 504 surrounds periphery 514 of compound window 506. In FIG. 24B, light construction 522 includes frame section 524 with surrounds compound window 526. Compound window 526 includes transparent lights 528, 530 and spacer 532. Frame section 524 surrounds periphery 534 of compound window 526 with polyurethane filling gap 536 between outer edges 538, 540 of transparent lights 528, 530. In FIG. 24C, light construction 552 includes frame section 554 with surrounds window 556 which is just a transparent light. Frame section 554 surrounds periphery 558 of window 556. As set forth above, the RIM process is used embed the light construction with the polyurethane in this embodiment. In such a process, an isocyanate component is typically reacted with an isocyanate-reactive component (i.e., a polyol) in a mold having an interior cavity with a region complementary to the frame sections. A particularly useful polyurethane composition and RIM molding process is provided by U.S. Pat. No. 6,242,555, which has already been incorporated by reference. The details of this process are set forth above and in this patent. Moreover, the application of one or more coupling agents prior to molding is found to further enhance adhesion when glass panels are used. More preferably, two or more coupling agents are applied to the glass surfaces prior to molding of a construction incorporating the frame sections. The details of the coupling agents is the same as that set forth above. In a variation the glass panels are treated with one or more primers. Useful primers include one or more of the following components: organosilanes, polyurethanes, polyesters, pigments, and solvents. Examples of suitable primers include Betaseal™ 43518 Glass Primer and Betaseal™ 43520A Glass Primer commercially available from Dow Chemical Company. Betaseal™ 43518 Glass Primer is a proprietary composition which includes toluene, methyl alcohol, and an organosilane Betaseal™ 43520A Glass Primer is a proprietary composition which includes toluene, methyl ethyl ketone, carbon black, n-butyl acetate, potassium oxide, xylene, polyurethane, polyester, and an organosilane. Typically, the glass is first treated with Betaseal™ 43518 Glass Primer and then Betaseal™ 43520A. It is readily apparent that these primers and in particular the Betaseal™ 43518 Glass Primer and Betaseal™ 43520A contain a number of components that improve adhesion of the RIM molded frame to the glass panels.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A method of forming a window frame, the method comprising:

a) reacting an isocyanate component with an isocyanate-reactive component in a mold, the mold having an interior cavity complementary to a stepped frame section including four sides and having a lower step surface and an upper step surface, the lower step surface being adapted to receive a first light-panel having a first length and a first width and the upper step surface being adapted to receive a second light-panel having a second length and a second width, the first length being less than the second length and the first width being less than the second width, wherein:

the isocyanate component comprises:

an isophorone diisocyanate (IPDI) trimer/monomer mixture having an NCO content of from 24.5 to 34% by weight; and the isocyanate-reactive component comprises:

a polyetherpolyol having terminal OH groups, an average nominal functionality of 2 to 4, and an average equivalent weight of from 800 to 4000;

at least one chain extender component having as functional groups only aliphatic or alicyclic OH groups; and at least one amine-initiator component; and wherein step a) is performed in the presence of:

at least one catalyst component selected from the group consisting of organolead (II), organobismuth (III), and organotin (IV) catalysts;

at least one pigment component; and at least one antioxidant/UV absorber component.

2. The method of claim 1 wherein the window frame is molded in contact with a glass surface.

3. The method of claim 2 wherein the glass surface is treated by a primer comprising at least one component selected from the group consisting of organosilanes, polyurethanes, polyesters, pigments, solvents, and combinations thereof.

4. The method of claim 1 wherein the first light-panel and the second light-panel are laminated together.

5. The method of claim 1 wherein the first light-panel and the second light-panel each independently have a curved central region and a flat peripheral region.

6. The method of claim 1 wherein the first light-panel and the second light-panel are part of an insulated glass unit wherein the first light-panel and the second light-panel are separated by an edge spacer which together with the first light-panel and the second light-panel defines a sealed central cavity between the first light-panel and the second light-panel.

7. The method of claim 1 wherein the window frame comprises one or more internal surfaces that define a hollow cavity.

8. The method of claim 7 further comprising a foamed material within the hollow cavity.

9. The method of claim 8 wherein the foamed material is a foamed plastic.

10. A method of forming a window frame comprising a stepped frame section having a lower step surface and an upper step surface, the lower step surface and the upper step surface complementary to edge detail of a window assembly, comprising:

a) reacting an isocyanate component with an isocyanate-reactive component in a mold, the mold having an interior cavity complementary to the stepped frame section having a lower step surface and an upper step surface, the lower step surface being adapted to receive a first light-panel having a first length and a first width and the upper step surface being adapted to receive a second light-panel having a second length and a second width, the first length being less than the second length and the first width being less than the second width, wherein:

the isocyanate component comprises:

an isophorone diisocyanate (IPDI) trimer/monomer mixture having an NCO content of from 24.5 to 34% by weight; and the isocyanate-reactive component comprises:

a polyetherpolyol having terminal OH groups, an average nominal functionality of 2 to 4, and an average equivalent weight of from 800 to 4000;

at least one chain extender component having as functional groups only aliphatic or alicyclic OH groups; and at least one amine-initiator component.

* * * * *